US009222317B2

(12) United States Patent
Yemington

(10) Patent No.: US 9,222,317 B2
(45) Date of Patent: Dec. 29, 2015

(54) RISER TECHNOLOGY

(71) Applicant: MY Technologies, L.L.C., Sugar Land, TX (US)

(72) Inventor: Charles R. Yemington, Arlington, TX (US)

(73) Assignee: My Technologies, L.L.C., Sugar Land, TX (US)

( * ) Notice: Subject to any disclaimer, the term of this patent is extended or adjusted under 35 U.S.C. 154(b) by 0 days.

(21) Appl. No.: 13/623,665

(22) Filed: Sep. 20, 2012

(65) Prior Publication Data

US 2013/0014688 A1 Jan. 17, 2013

Related U.S. Application Data

(63) Continuation of application No. 12/714,919, filed on Mar. 1, 2010, now abandoned.

(60) Provisional application No. 61/225,601, filed on Jul. 15, 2009, provisional application No. 61/232,551, filed on Aug. 10, 2009, provisional application No. 61/252,815, filed on Oct. 19, 2009, provisional application No. 61/253,230, filed on Oct. 20, 2009, provisional application No. 61/253,200, filed on Oct. 20, 2009.

(51) Int. Cl.

| | |
|---|---|
| ***E21B 19/00*** | (2006.01) |
| ***B66C 13/02*** | (2006.01) |
| ***E21B 19/22*** | (2006.01) |
| ***B63B 35/44*** | (2006.01) |

(52) U.S. Cl.

CPC ..... *E21B 19/006* (2013.01); *B63B 35/44* (2013.01); *B66C 13/02* (2013.01); *E21B 19/002* (2013.01); *E21B 19/004* (2013.01); *E21B 19/22* (2013.01)

(58) Field of Classification Search

USPC ..... 166/355, 339, 341, 350–352, 360, 367, 166/378–380, 77.51, 85.1; 405/158, 169, 405/170, 184.4, 184.5, 195.1, 201, 202, 405/224.2; 414/137.5; 114/264, 268

See application file for complete search history.

(56) References Cited

U.S. PATENT DOCUMENTS

| | | | | | |
|---|---|---|---|---|---|
| 3,043,255 | A | * | 7/1962 | Bauer et al. | 114/264 |
| 3,718,266 | A | * | 2/1973 | Donnally | 414/22.71 |
| 3,817,412 | A | * | 6/1974 | Mercier et al. | 414/800 |
| 3,884,364 | A | * | 5/1975 | Mercier et al. | 414/137.5 |
| 3,895,677 | A | * | 7/1975 | Bokenkamp | 166/359 |
| 3,981,369 | A | * | 9/1976 | Bokenkamp | 175/5 |
| 3,999,617 | A | * | 12/1976 | Ilfrey et al. | 175/7 |
| 4,004,532 | A | * | 1/1977 | Reynolds | 114/256 |
| 4,063,650 | A | * | 12/1977 | Homer | 105/29.1 |

(Continued)

*Primary Examiner* — Matthew Buck

(74) *Attorney, Agent, or Firm* — Andrus Intellectual Property Law, LLP

(57) ABSTRACT

The present invention is directed to novel methods and apparatus for the design, installation, use, recovery, and reuse of a Self Supporting Riser (SSR) for wells that are not under a platform. The SSR of the present invention uses standardized joints that can be recovered, potentially warehoused, and recombined in different configurations for different purposes or locations. Emphasis is on methods and apparatus that use relatively small vessels subject to high motions in the installation, use and recovery of the SSR. The SSR is adapted for high current and/or deep water applications for purposes of downhole well intervention and subsea equipment installation. In contrast to the apparatus and processes of the prior art, this invention addresses a comprehensive system design.

5 Claims, 27 Drawing Sheets

(56) References Cited

U.S. PATENT DOCUMENTS

| | | | | |
|---|---|---|---|---|
| 4,108,318 | A * | 8/1978 | Rode et al. | 414/22.51 |
| 4,176,722 | A * | 12/1979 | Wetmore et al. | 175/7 |
| 4,367,796 | A * | 1/1983 | Bolding | 166/341 |
| 4,512,409 | A * | 4/1985 | Gregory et al. | 166/352 |
| 4,572,304 | A * | 2/1986 | Mahar et al. | 175/5 |
| 4,574,241 | A * | 3/1986 | Stelly | 324/326 |
| 4,694,909 | A * | 9/1987 | Stephenson et al. | 166/356 |
| 4,735,267 | A * | 4/1988 | Stevens | 166/345 |
| 6,042,303 | A * | 3/2000 | Head | 405/195.1 |
| 6,196,322 | B1 * | 3/2001 | Magnussen | 166/350 |
| 6,217,258 | B1 * | 4/2001 | Yamamoto et al. | 405/201 |
| 6,321,675 | B1 * | 11/2001 | Dybdahl et al. | 114/264 |
| 6,470,969 | B1 * | 10/2002 | Sørhaug et al. | 166/355 |
| 6,503,022 | B1 * | 1/2003 | Nuss | 405/195.1 |
| 6,561,112 | B1 * | 5/2003 | Benson et al. | 114/230.1 |
| 6,752,213 | B1 * | 6/2004 | van der Poel | 166/355 |
| 6,766,860 | B2 * | 7/2004 | Archibald et al. | 166/341 |
| 6,854,930 | B2 * | 2/2005 | Pionetti | 405/172 |
| 7,021,402 | B2 * | 4/2006 | Beato et al. | 175/7 |
| 7,451,821 | B2 * | 11/2008 | Rashid et al. | 166/358 |
| 7,628,225 | B2 * | 12/2009 | Petersson et al. | 175/5 |
| 7,819,204 | B2 * | 10/2010 | Bamford | 175/5 |
| 7,934,560 | B2 * | 5/2011 | Roveri et al. | 166/345 |
| 8,079,426 | B2 * | 12/2011 | Petersson | 175/5 |
| 8,087,464 | B2 * | 1/2012 | Rodrigues et al. | 166/339 |
| 2004/0156684 | A1 * | 8/2004 | Pionetti | 405/224.2 |
| 2007/0044972 | A1 * | 3/2007 | Roveri et al. | 166/367 |
| 2007/0251725 | A1 * | 11/2007 | Banks | 175/5 |
| 2009/0126617 | A1 * | 5/2009 | Millheim | 114/264 |
| 2009/0129867 | A1 * | 5/2009 | Millheim | 405/166 |
| 2010/0071906 | A1 * | 3/2010 | Rodrigues | 166/352 |
| 2010/0172697 | A1 * | 7/2010 | Millheim | 405/166 |
| 2011/0094430 | A1 * | 4/2011 | Millheim | 114/264 |
| 2011/0135396 | A1 * | 6/2011 | Millheim | 405/166 |
| 2011/0286806 | A1 * | 11/2011 | Millheim | 405/224.2 |

* cited by examiner

RISER TECHNOLOGY

CROSS-REFERENCE TO RELATED APPLICATIONS

This application claims benefit of U.S. provisional application Ser. Nos. 61/225,601, filed Jul. 15, 2009; 61/232,551, filed Aug. 10, 2009; 61/252,815, filed Oct. 19, 2009; 61/253,230, filed Oct. 20, 2009; 61/253,200, filed Oct. 20, 2009, all of which are incorporated herein by reference.

STATEMENT REGARDING FEDERALLY SPONSORED RESEARCH OR DEVELOPMENT

Not Applicable.

FIELD OF INVENTION

The present invention is directed to a practical, low cost modular, reusable tubular/Self Supporting Riser (SSR) and provisions for interfacing a vessel subject to high motions to the SSR. The SSR can be easily installed and recovered in a wide range of water depths and in areas of high current. The installed SSR can be left untended. Moreover, the SSR can be configured for workover of a well through the SSR using coiled tubing, joints of drill pipe, or wire line equipment and fluids from wells drilled to fossil hydrocarbon reservoirs deep below the sea can be taken directly to the vessel through the SSR.

BACKGROUND OF THE INVENTION

The present invention is directed to a practical, low cost, reusable Self Supporting Riser (SSR) made from modular tubular joints and specialty joints that can be assembled and reassembled interchangeably for different locations and applications. Further, the present invention is directed to the interface between an SSR and a vessel subject to relatively high motions in all 6 degrees of freedom, including heave, pitch, and roll motions, for downhole work in a well through the SSR.

The concept of a free standing or self supporting riser is known and has been used as an aid to offshore production from oil wells. A prior art SSR typically consists of as a minimum: an anchor or infrastructure connection location on the seafloor, pipe joints, buoyancy, and interfaces for use. Previous SSRs were typically designed with emphasis on the installed function of the riser and little attention was normally given to installation and even less consideration to removal of the riser.

Downhole intervention in deep water satellite hydrocarbon wells has been done primarily by a Mobile Offshore Drilling Unit (MODU) with capability to deploy a vessel supported riser and deploy drill pipe through the riser and down into the well. A satellite well is one that can not be vertically accessed from a fixed or moored surface production facility. A MODU is a large, high cost, multipurpose vessel which frequently can not be economically justified, given the limited additional product that can be recovered from a partially depleted reservoir.

SUMMARY OF THE INVENTION

The present invention is directed to novel methods and apparatus for the design, installation, use, recovery, and reuse of a Self Supporting Riser (SSR) for wells that are not under a platform.

The SSR of the present invention uses standardized joints that can be recovered, potentially warehoused, and recombined in different configurations for different purposes or locations.

Emphasis is on methods and apparatus that use relatively small vessels subject to high motions in the installation, use and recovery of the SSR.

The SSR is adapted for high current and/or deep water applications for purposes of downhole well intervention and subsea equipment installation.

In contrast to the apparatus and processes of the prior art, this invention addresses a comprehensive system design that meets the following:

- Modular, reusable Self Supporting Riser (SSR) designed to be readily adapted for different locations and functions
  - SSR designed for low cost fabrication, and installation, relocation and recovery by a small vessel
  - SSR designed for high current areas and/or deep water applications with mid-water buoyancy and selected joint stiffness to optimize verticality of the SSR
  - SSR designed with mid-water buoyancy located to tune the resonant frequency of riser segments and the overall riser
  - SSR designed for use with an umbilical to control buoyancy and operational equipment
- Novel vessel configuration and outfitting for low cost SSR installation and recovery by a small vessel
- Method for efficient installation and recovery of a SSR by a small vessel
- Umbilical installed along with riser
- Umbilical control of operational equipment and/or provisions for heating locations in joints that risk hydrate formation in operation
- Novel vessel configuration and outfitting for intervention and work over through the SSR by a small vessel
- Novel riser vessel interface system for small vessel subject to high vessel motions with provisions for dealing with all 6 degrees of vessel motion
- An SSR extension suited for down hole intervention and work over
- Method and apparatus for down hole intervention through a SSR Provisions for dealing with contingencies

DESCRIPTION OF THE EMBODIMENTS OF THE INVENTION

Figure 1:
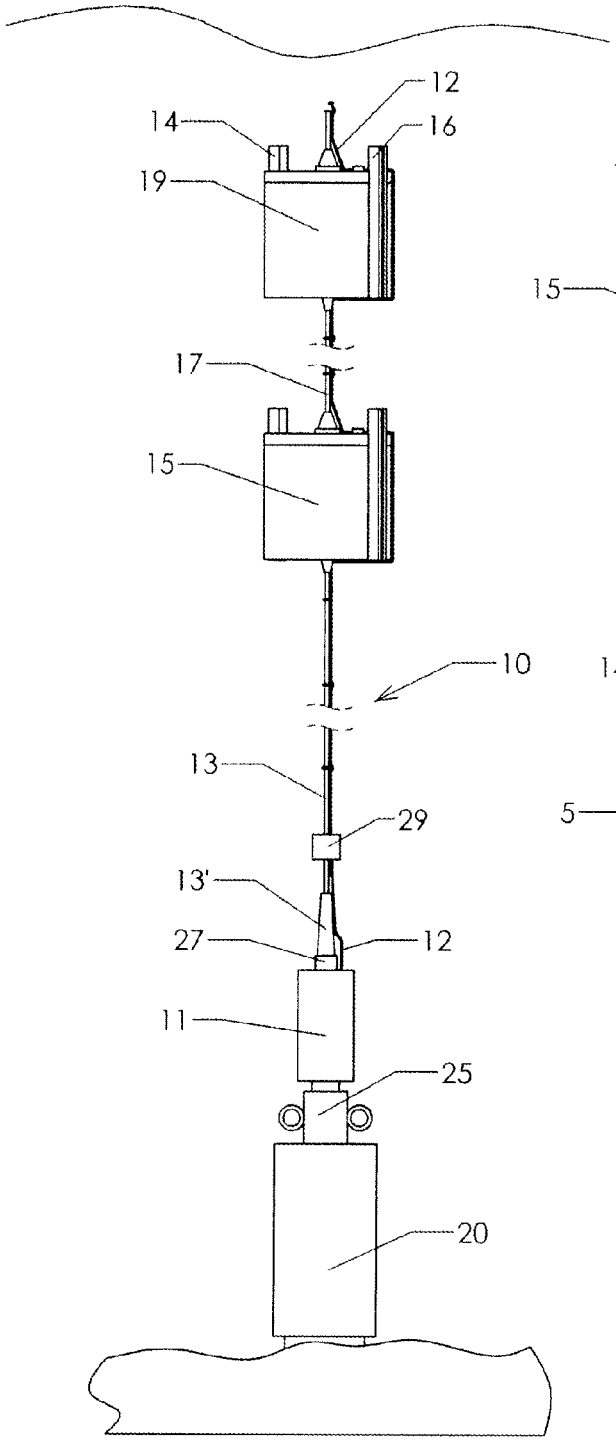
FIG. 1 is a schematic view of a self supporting riser of the present invention.

A Self-Supporting Riser (SSR) of the present invention is readily configured to provide downhole intervention in a well. The vessels used for installation or recovery and intervention are small vessels.

The subsea wells of specific interest for the present invention are those that have been drilled off-shore in water depths of approximately 500 to 10,000 feet and are not located under a host facility. Thus, the SSR of the present invention is a substantial structure. The SSR extends up from the seafloor with the top of the SSR near but below the water surface and typically below the wave zone and ship traffic. The modular components of the present invention can be assembled into unique SSR configurations and installed to meet the requirements of depth, parameters such as current found at the location and specific application needs, and to fit a particular existing well head or tree. The hydrocarbon production equipment to which the SSR is connected may be sea floor architecture such as a wellhead connector profile (wellhead); a vertical tree or a horizontal tree (tree); or other elements of seafloor infrastructure of a hydrocarbon production system.

When not in service on a wellhead or tree the SSR may be temporarily moored by line(s) of wire rope, soft line, or chain or by mechanical connection to an anchor such as a suction pile or gravity or embedment anchor at the seafloor. The SSR may be similarly moored for well test or production functions rather than being rigidly connected to an element of seafloor infrastructure. Provisions for attaching rigging for mooring may be incorporated into specialty joints at the lower end of the SSR to facilitate attachment to an anchor before, during, or after the service period of the SSR. A rigging attachment may also be by securing a mooring collar or yoke on the riser to bear against a flange or other device on the SSR. Rigging provisions for mooring are arranged so that the Seafloor Shutoff Device may be part of the SSR when it is anchored, or the SSR elements normally above the Seafloor Shutoff Device may be moored to the anchor without the seafloor shutoff device. This arrangement facilitates disconnecting an SSR from its seafloor shutoff device and leaving the shutoff device on the tree or wellhead.

The system arrangement also facilitates underwater reconfiguration of the SSR. Specialty joints with active components such as the seafloor shutoff device can be configured with remotely operable connectors on each side of the active device. Opening the connector above an active device allows the SSR segments above it to be anchored. The connector below the active device can then be opened and the active device can be recovered for maintenance or reconfiguration. Similarly, an active device which is no longer needed in the SSR can be parked or recovered without recovery of the rest of the SSR.

The present invention includes provisions to reduce the structural loads, bending moments, and fatigue cycling seen by the tree or wellhead to which the SSR is attached. For any specific application this may include provisions for making the SSR more nearly vertical immediately above the wellhead or tree, using a flexible specialty joint above the wellhead or tree to allow the SSR to incline when not in service to greatly reduce the lever arm of current drag forces on the SSR, or mooring the SSR when it is not in service.

The present invention also includes provisions to assemble an SSR for a particular purpose, water depth, current conditions, or location from an inventory of standardized joints and to recover the joints and assemble some or all of them into a different SSR configuration for a different application.

Self Supporting Riser (SSR) Configuration

Referring to FIG. 1, a Self Supporting Riser (SSR) 10 which may include a seafloor shutoff device (SSD) 11 is attached to a wellhead or tree 20 using a commercially available connector 25 suited to the wellhead or the tree.

Joint Arrangement

The modular components of the riser 10 can be assembled in unique arrangements to suit local environmental conditions or specific task requirements. For example, one or more buoyancy modules, with provisions to regulate the buoyancy as required by the application, can be placed so as to support the weight of the SSR during deployment, to distribute tension more evenly in the SSR, and/or to minimize the inclination of the riser due to a specific water current profile. As illustrated in FIG. 1, riser 10 has one or more buoyancy modules 15 and 19. The uppermost buoyancy module 19 is referred to herein as the near-surface buoyancy module and any module below module 19 is referred to herein as a mid-water buoyancy module.

A plurality of joints comprising regular joints and specialty joints define the SSR. Joints are attached to the SSD 11 and extend to mid-water buoyancy module 15 illustrating a segment 13 of SSR 10. Additional joints extend from mid-water buoyancy module 15 to the near-surface buoyancy module 19 illustrating another segment 17 of SSR 10. The SSR may have one, two or more segments that define the SSR. The uppermost module 19 is typically below the wave zone and ship traffic and preferably deep enough to avoid particularly strong near surface water currents, and is preferably only a single module so as to reduce the frontal area exposed to near surface currents.

Interface to Subsea Infrastructure

At the lower end of the SSR is a connector 25 suited to the target wellhead or tree or another element of seafloor infrastructure. A device for guiding the CT tubing, used in downhole intervention, through the wellhead or tree may be immediately above the connector. The Seafloor Shutoff Device (when used) may be above the tubing guide device or may be directly above the connector if the guide device is not used. The SSD and connector may be custom built or may be commercially available. Both are reversible, remotely operated mechanical devices suitable to maintain a continuous pressure boundary for containing pressure of reservoir fluids and circulated fluids. The connection is structurally adequate for anchoring and tensioning the SSR and for withstanding the bending moments imposed by horizontal loads on the riser, particularly current acting high up on the SSR. The tubing guide device incorporates provisions to guide tools, pipe, or tubing into the wellhead or tree and prevent interference or restriction when they are lowered through the riser and into the well and subsequently recovered. This function is particularly important when the device interfaces between different internal diameters or offset of the riser and the bore in a wellhead or tree or the casing wellhead and production tubing or other devices which may be in or suspended below the wellhead or tree.

Seafloor Shutoff Device

The Seafloor Shutoff Device (SSD) 11, when required, can have a profile on top suitable for a remotely operable mechanical connection 27. This allows the riser to be disconnected from the SSD and removed; leaving the SSD in place to, for instance, maintain reservoir isolation.

Some functions of a Blow Out Preventer (BOP) are incorporated into the SSD 11 described here while other selected BOP functions can be incorporated into other specialty joints of the SSR or between the vessel and the SSR for well intervention. Primary among the functional provisions in the SSD 11 is the ability to shear tubing or pipe if necessary and seal between the riser and the reservoir. When there is no tubing or pipe passing through the device this can consist of simply closing one or more valves. The device 11 may also include provisions to sever or seal off the tubing or pipe when circumstances require closure while there is tubing or pipe passing through the SSD. This may include some combination of shearing the tubing or pipe, closing a valve, inflating an inflatable annular packer to close off the annular space between the drill pipe or tubing and the outer pressure boundary, or pinching off the tubing or pipe and holding any intervention tubing, pipe or tools downhole of SSD 11 with sufficient force to create a pressure boundary to prevent escape of fluids driven by reservoir pressure. The required action may be in response to a remote signal or loss of remote signal, or due to sensing loss of riser tension sufficient to indicate loss of structural integrity of the riser. Energy to seal off the reservoir is stored locally. This energy can be replenished and the function reset via umbilical or by ROV intervention. The functions may be duplicated to provide redundancy. The device 11 may include interfaces for a Remotely Operated Vehicle (ROV) to override or provide power or controls normally provided by an umbilical. Device 11 may also include heaters to prevent or remediate hydrate formation.

The function to crimp tubing or pipe (if used) is designed to hold with sufficient force to create a pressure boundary to prevent escape of fluids driven by reservoir pressure and is preferably done with jaws shaped to crimp the tubing or pipe without severing it, i.e. there is no shearing action and the tubing or pipe is deliberately deformed in a manner to seal it with the least practical reduction in its tensile strength so that it can subsequently be used to lift and recover the portion of tubing or pipe that is below the SSD 11.

The SSD can also be closed when a fully reversible pressure boundary is required and there is no tubing or pipe deployed through it. This function of providing a boundary is of primary importance when the riser interfaces to a horizontal tree or directly to a wellhead. If a vertical tree is present the tree valves can provide this function, but this SSD function can also be used to isolate a vertical tree from the riser. This function of the SSD 11 may be duplicated when a redundant pressure boundary is required by regulations or engineering considerations.

The SSD includes connection provisions such that the SSR elements above it can be disconnected from the SSD, and a MODU BOP can be engaged while the SSD is closed, to facilitate well reentry under extreme upset conditions.

Lower SSR Closure

An additional valve or closure 29 may be included in the SSR above the connection 27. This arrangement facilitates removing the riser above the SSD 11 without loss of fluids from the riser while the SSD is left in place on the wellhead or tree.

Buoyancy Modules

Gas can buoyancy modules are integral joints (referred to herein as a specialty joint) of the riser suitable for installation at any elevation along the SSR. The buoyancy modules are located to keep all segments of the riser in tension to prevent buckling, to provide a restoring force against current drag, and to distribute buoyancy so as to avoid excessive tension at any one point in the riser. Buoyancy modules are also located so as to extend the fatigue life of the riser by providing higher tension in the segments or parts of the riser that are potentially exposed to Vortex Induced Vibration (VIV) and to tune the riser by placing high mass nodes at key locations so that the tension in the riser and the distance between buoyancy modules tunes the resonant frequency of that segment of the riser preferably well above the excitation frequency from vortex shedding, coupled vessel motions, and other excitations. Multiple modular buoyancy modules are used at locations along the riser where the desired buoyancy is greater than can be provided by a single module. Individual buoyancy modules may be selectively or partially ballasted as required to optimize buoyancy and buoyancy distribution for different applications and different stages in the application of the SSR.

Making the modules the same diameter facilitates engaging the modules with guides for deployment and recovery through the moonpool.

Buoyancy modules are preferably all constructed to the same specifications, preferably gas can, so as to be interchangeable during installation and for supply, staging, and sparing. Buoyancy modules 15, and any other module at other locations (herein referred to as mid-water buoyancy modules) below the near-surface buoyancy 19 along with analytically chosen variations in the stiffness of specialty joints near the buoyancy elevations are used to distribute the bending moment caused by current drag and other non-vertical forces that would otherwise be concentrated at the lower end of the riser. The bending can be distributed over multiple locations, primarily near the bottom and top of the mid-water buoyancy module(s).

Buoyancy provides a horizontal restoring force at its location, including in the most common instance which is when the drag that pushes the riser away from vertical is concentrated on the upper part of the riser. The restoring force is proportional to the sine of the angle of buoyancy offset times the upward force of the buoyancy so buoyancy must be displaced horizontally before it develops a restoring moment and it therefore cannot completely eliminate bending at the anchor point, but as used here, buoyancy and selective stiffness do reduce the bending at the anchor point, the point of connection of the SSR to the seafloor infrastructure.

Avoiding concentration of the bending moment allows the use of smaller stress joints. Smaller stress joints are made from smaller forgings and machined on smaller machines so they generally cost less and can be obtained with shorter lead time. Smaller stress joints are also easier to transport and install than larger stress joints.

Figure 1A:
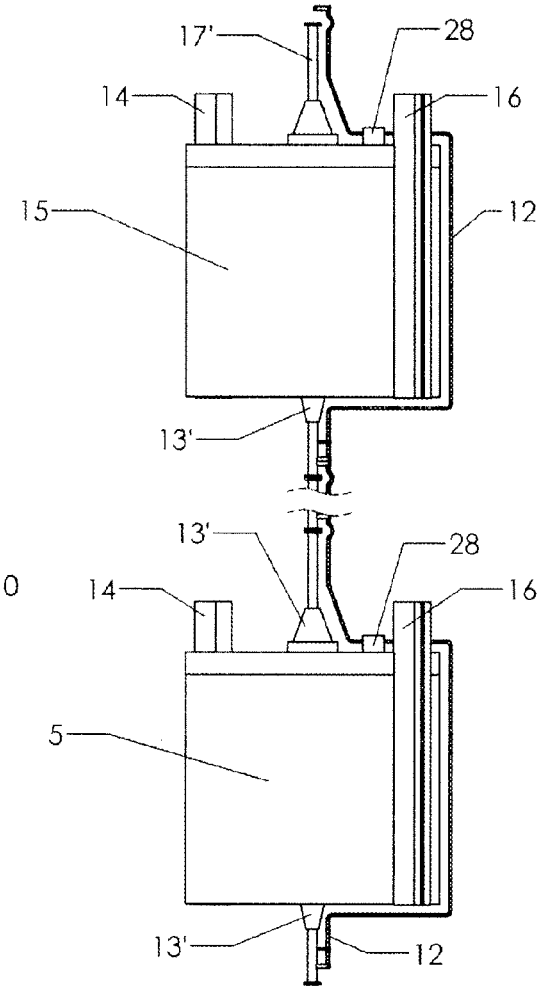
FIG. 1A is a schematic view of the riser in FIG. 1, illustrating two mid-water buoyancy modules and also a control umbilical associated with the riser.

FIG. 1A illustrates another embodiment of joints defining riser 10 having two mid-water buoyancy modules 15 and 5. Localized riser stiffness is chosen to distribute the curvature of the riser and control the inclination of nearby buoyancy modules so as to make the riser 10 more nearly vertical between the mid-water buoyancy and the seafloor and thereby reduce bending at the base or anchor point of riser 10. Specialty joints 13' or 17' (the use of prime is used to identify a specialty joint) near mid-water buoyancy modules 5 or 15 respectively are chosen to incorporate a particular stiffness immediately above or below each buoyancy module and thus influence the inclination of the buoyancy modules and the shape of riser curvature.

Mid-water buoyancy can also be used to facilitate or enhance the use of flexible pipe specialty joints, which may be combined with bend limiters, as an alternative to stress joints.

Umbilical

FIGS. 1 and 1A also show the use of a control umbilical 12 that is associated with the riser 10 which allows a vessel to monitor instruments and operate various equipment including for example the seafloor shutoff device (SSD) 11 and buoyancy modules (5, 15, or 19). The umbilical from the near surface buoyancy 19 to the lower end of the SSR is installed as part of SSR installation.

The umbilical 12 may consist of multiple independently jacketed bundles for different purposes, or may consist of a single jacketed bundle containing one or more types of fluid, electrical, and optical conductors. Fluid conductors consist of high pressure (typically 5,000 to 15,000 psi) steel tubes or hoses ranging in internal diameter from ⅛ inch to 1 inch or more. Electrical conductors consist of individually insulated wires suitable for voltages up to 10,000 Volts and/or current up to several hundred Amps. Optical fibers for telemetry or communication may also be included. The umbilical has breakouts 28 (FIG. 1A) as appropriate for instruments and controls for buoyancy modules, riser instruments, and active devices in specialty joints of the riser. There are provisions for connecting the umbilical through a jumper to the tree or other equipment found on the seafloor.

The umbilical includes provisions for de-ballasting buoyancy module chambers by supplying compressed gas from the vessel to displace seawater from the chamber(s), and provisions for ballasting the chambers by venting gas to the surface. Venting to the surface through the umbilical in this manner accelerates ballasting by taking advantage of the difference in ambient pressure between the buoyancy chamber and the surface. Control of the venting is incorporated to prevent damage to the buoyancy module by the differential pressure between pressure at depth of the buoyancy module and atmospheric pressure.

Modular Joints

Except for the uppermost and lower most ends of the SSR, most joints are connected to any other with the same tooling and methodology.

A unique combination of standard joints and specialty joints may be selected to define the SSR for a specific riser for a specific well. Every riser can be a unique configuration to meet the specific requirements of the application.

Conventional oil field casing joints may be employed in the riser 10, including joints being 5 and 7 inch diameter and having a pressure rating of 10,000 to 15,000 psi or more, and typically having 40 to 80 feet nominal joint length. Joints may be connected by threads, by flanges, or by other commercially available connectors.

FIGS. 1 and 1A, illustrate that the joints that define the SSR are selected as a combination of regular joints and specialty joints to produce various embodiments of a Self Supporting Riser (SSR). While the joints are modular they are not all connected in the same order. Further the joints in a segment of the riser 13 or 17 may include more specialty joints than the specialty joints 13' or 17' illustrated for a specific purpose or function to define the SSR.

Specialty Joints

A "specialty joint" is used herein to mean a joint specifically tailored for a specific purpose. Examples of specialty joints are joints having tapered sections, flexible pipe joints, flexible pipe with bend limiters, a device for support of coil tubing running through the riser during intervention, a device to control flow or pressure communication through the riser, a device for reservoir isolation, or an extension device at the top of the riser for interface of the riser to a vessel for downhole intervention and/or a device for quick release from the SSR under emergency conditions. Between the use of conventional joints and specialty joints the riser 10 is assembled from modules in a combination that is optimized for local conditions and a particular function such as well testing, production or downhole intervention.

Figure 1B:
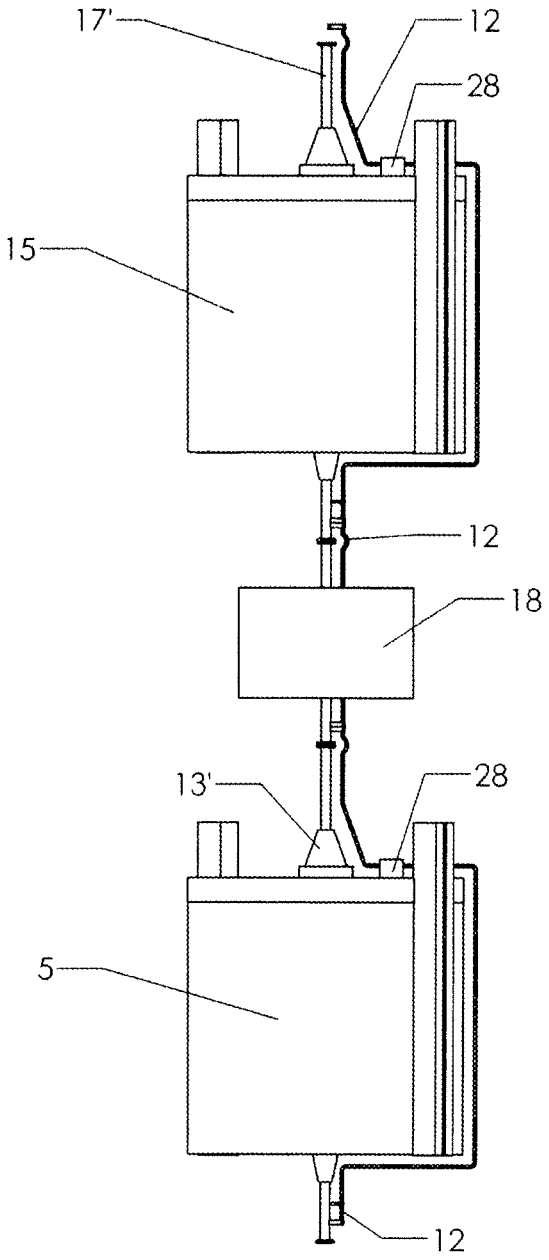
FIG. 1B is a schematic view of the riser in FIG. 1, illustrating two mid-water buoyancy modules and a device having selected functions of a blow out preventer between the modules.

Referring to FIG. 1B, a joint 18 (referred to herein as a specialty joint) that incorporates selected functions of a BOP (Blow Out Preventer) is illustrated positioned between mid-water buoyancy modules 5 and 15. Alternately or in a complementary manner, selected BOP functions can be located above or below the near surface buoyancy or in the riser extension. Some typical BOP functions such as reservoir isolation may be located or duplicated in joint 18 and in the Seafloor Shutoff Device 11. Other well control functions (such as annular seals, sensors, circulation controls, etc) may be located only in specialty joint 18 as shown in FIG. 1B. Other BOP functions such as provisions for re-entry under extreme upset conditions need not be included in the SSR.

Partitioning the traditional BOP functions in this manner enhances features such as the ability to maintain well pressure control while introducing long tool strings and avoids the cost of features needed only when drilling into unexplored formations or after unusual upset conditions have been encountered. Device 18 may also include heaters to prevent or remediate hydrate formation.

Figure 1C:
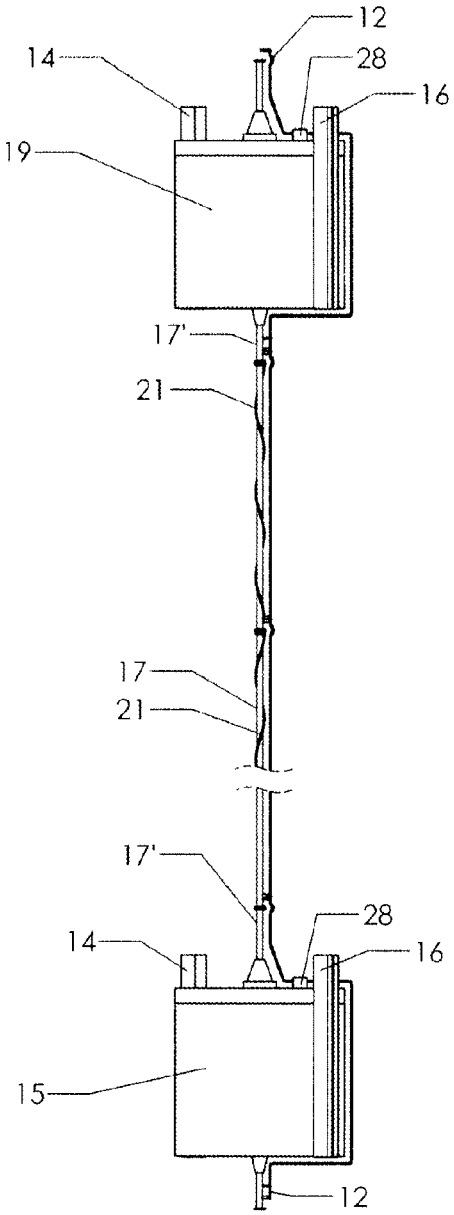
FIG. 1C is a schematic view of the riser in FIG. 1, illustrating wrapped joints below the upper-buoyancy module, creating strakes.

FIG. 1C illustrates that specialty joints below the near surface buoyancy 19 can be wrapped with a material 21, such as rope, to create strakes. The strakes can be formed by wrapping the material in a vertical helix in one direction and then in the other direction or by using multiple contra-helically wound lines. Strakes are used to extend the fatigue life of the riser by reducing Vortex Induced Vibration (VIV) at those elevations where the riser is exposed to stronger current. The umbilical 12 may also be used as the material to create strakes.

Figure 1D:
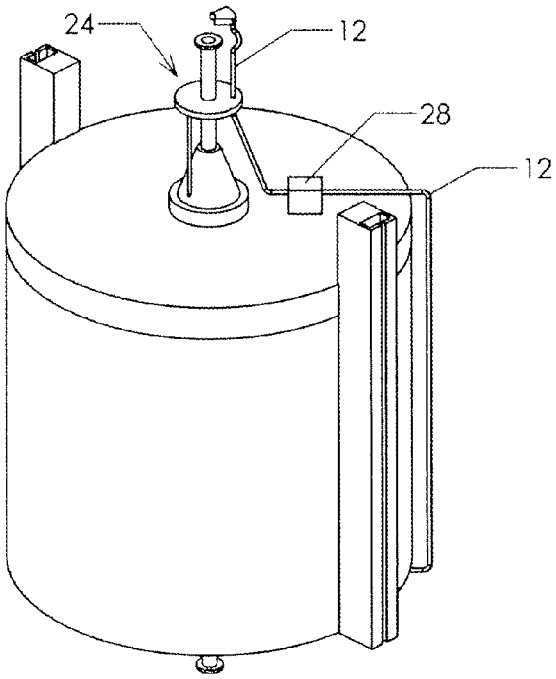
FIG. 1D is a schematic view of a buoyancy module with a tension sensor.

FIG. 1D illustrates that a specialty joint at or near the buoyancy modules may have sensors 24 for tension of the riser above and below the buoyancy. Tension sensors 24 may be near all buoyancy modules. The control umbilical 12 can have a breakout 28 for control of the buoyancy module and nearby active components and for activating sensor 24 and transmitting the tension information or data to the vessel.

Vessel Configured for SSR Installation or Removal

Figure 3:
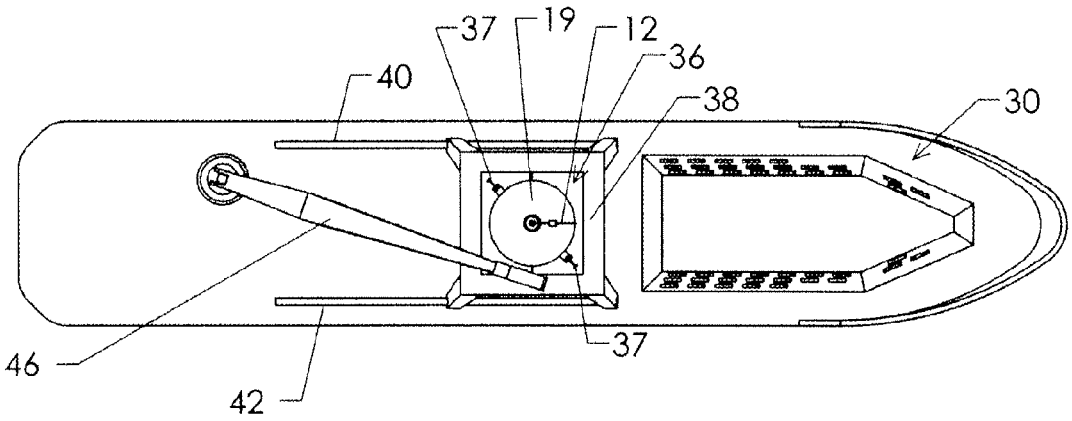
FIG. 3 is a schematic top view of the novel vessel configuration.
Figure 2:
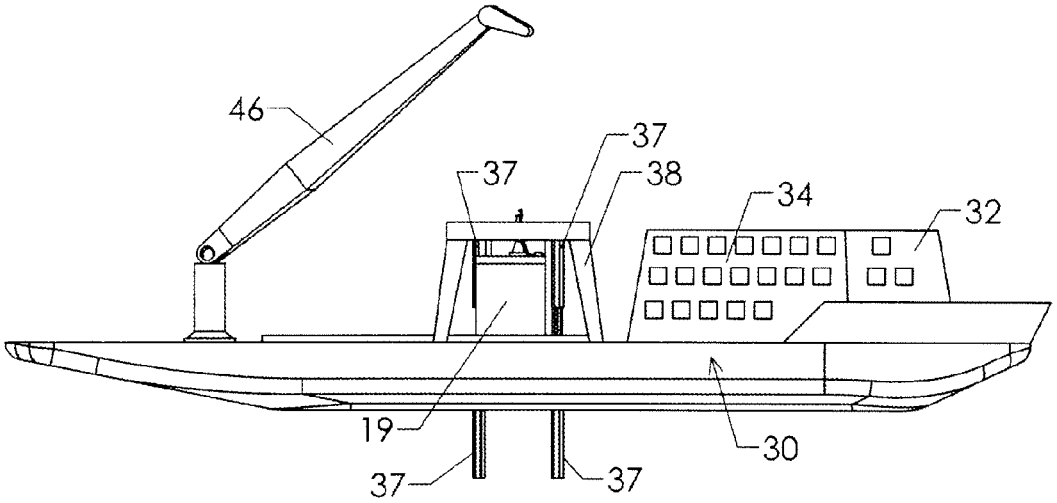
FIG. 2 is a schematic side view of a novel vessel configuration for low cost SSR installation and removal using a small vessel.
Figure 4:
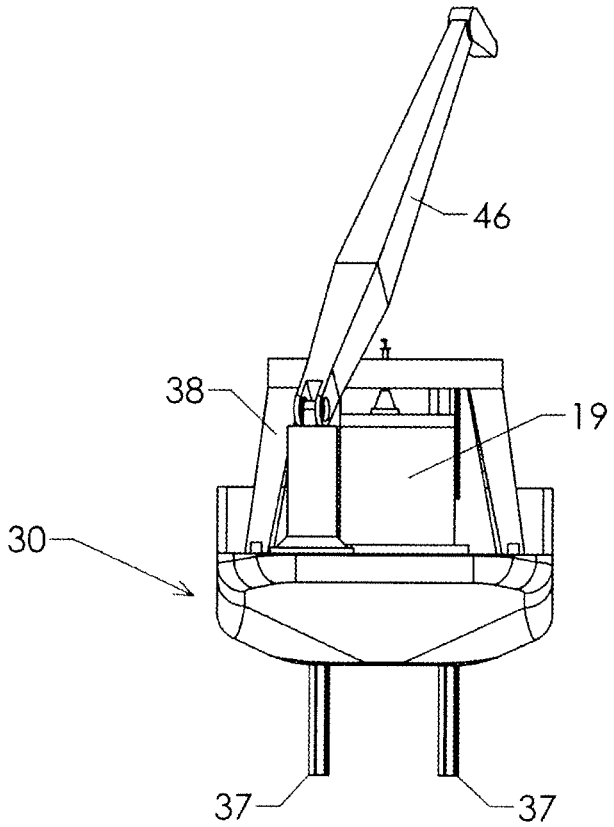
FIG. 4 is a schematic stern view of the novel vessel configuration.

Referring now to FIGS. 2, 3, and 4, a vessel 30 outfitted for installation or recovery of the modular SSR has a moon pool 36 that is sized to allow a large diameter specialty joint such as a buoyancy module 19, to pass through for installation and recovery. A gantry 38 can be mounted on deck on tracks 40 and 42 so that the gantry 38 may be over the moon pool 36 or rolled to a position that any modular joint of the riser, including specialty joints such as those with a buoyancy module, or other structure of the riser 10, can be picked up off the deck and positioned over or near the moon pool 36. Also on deck are one or more cranes 46. One crane 46 with heave compensation is of a size and positioned on deck such that it can handle all the modular joints of the riser 10 either individually, or in combination, during the installation or recovery of the riser 10 through the moon pool 36. Typical features of a vessel such as the vessel 30 include a forward bridge 32, and crew quarters 34.

Provisions for Optimization of Vessel Configuration for SSR Installation or Recovery:

Guides 37 in moonpool 36 facilitate SSR installation and recovery by a small vessel subject to high motions. Guides 37 extend below the keel and secure large diameter specialty joints such as the Seafloor Shutoff Device and buoyancy modules against the relative motion of the vessel and water during installation and recovery. Guides 37, preferably but not necessarily at two opposite corners of the moon pool 36, extend below the keel but can be retracted or removed for vessel transit and when not in use. Guide appurtenances or fittings 14 or 16 on each large diameter specialty joint fit to or in and run on moonpool guides 37. Lower ends of moonpool guides 37 have alignment ramps shaped to facilitate acquisition of guide appurtenances or fittings on buoyancy modules and other large diameter specialty joints for module recovery.

For recovery of large diameter specialty joints even when vessel motions are high, guide wires (not shown) which are captive on guides 37 can be attached to the guide appurtenances or fittings on the large diameter specialty joints by ROV or divers. Tensioning the guide wires as the large diameter specialty joint approaches the guide rails 37 brings the appurtenances into alignment with the guide rails in the moon pool. Referring to FIG. 1, appurtenance or fittings 14 and 16 are present on large diameter specialty joints, whether a buoyancy module or having another purpose, and fit to guides 37 for module joint installation or recovery.

The guide wires must be kept taut to prevent entanglement and to align fittings on large diameter specialty joints with guides 37 for recovery. This is preferably done with constant tension winches which together lift a significant portion of the suspended weight of the joints not yet recovered.

Figure 5:
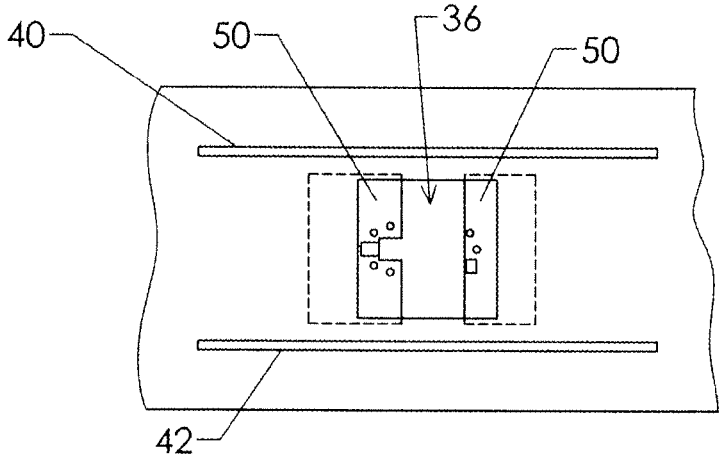
FIG. 5 is a top view of a retractable moonpool cover with the cover partially open.
Figure 5A:
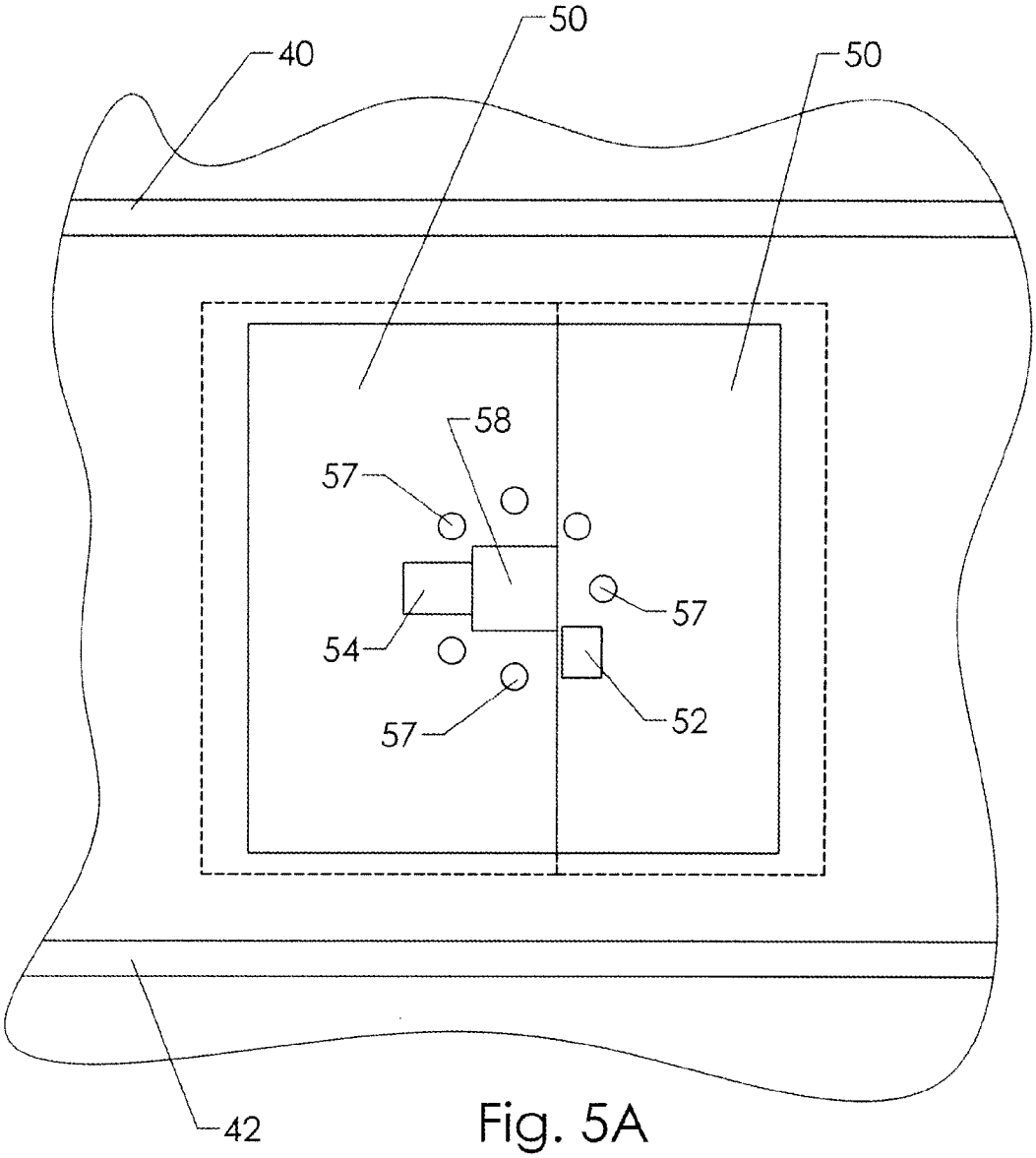
FIG. 5A is an enlarged view of moon pool cover shown closed and tools positioned on the cover.

Referring now to FIG. 5, a retractable moon pool cover 50 is shown retracted under a section of deck. FIG. 5A shows cover 50 closed with joint connection tooling 52, 54, and 57 positions on the cover. When closed the split cover provides a work surface/deck with a slot 58 to support the portion of the riser that is assembled and suspended below the vessel. The holder/slot 58 for suspended joints is aligned over the moonpool to facilitate supporting the suspended joints while a large diameter specialty joint such as a buoyancy module is engaged to the guides 37 in the moonpool.

It is apparent that the installation aids including the retractable work surface and the guides 37 could be located on a porch extending out from the vessel deck rather than over a moonpool, with the most significant disadvantage being greater distance from the vessel center of motion.

Joint Connection Tools:

The connections between the joints may be threaded couplings, bolted flanges, or mechanical connectors. For improved safety and efficiency, tools used to engage and break joint connections can be attached to the moonpool cover(s) 50 and located at said slot 58. Tools 52 and 54, illustrated by tongs 52 for joints connected by rotation and bolting tools 54 for joints connected by bolts and flanges, are required for engaging and separating riser joints. In the instance of bolted flange connections for example, tools for bolt tensioning and nut running can be integral to the moonpool cover. As the next joint is lowered with bolts captive in one half of the flange, the bolts run into the other half of the flange and into the bolt tensioner/nut running tools, which may be positioned in all or some of the openings 57 surrounding slot 58. The tools are activated, the connection is inspected, and the newly engaged joint is lifted, the moon pool cover(s) are opened, and the new assembly of joints is lowered into the moonpool. This is a significant safety feature on a vessel subject to high motions because it minimizes repetitive lifting of heavy tools that can swing with vessel motion and strike personnel or other equipment.

Installation & Removal of SSR

Figure 6:
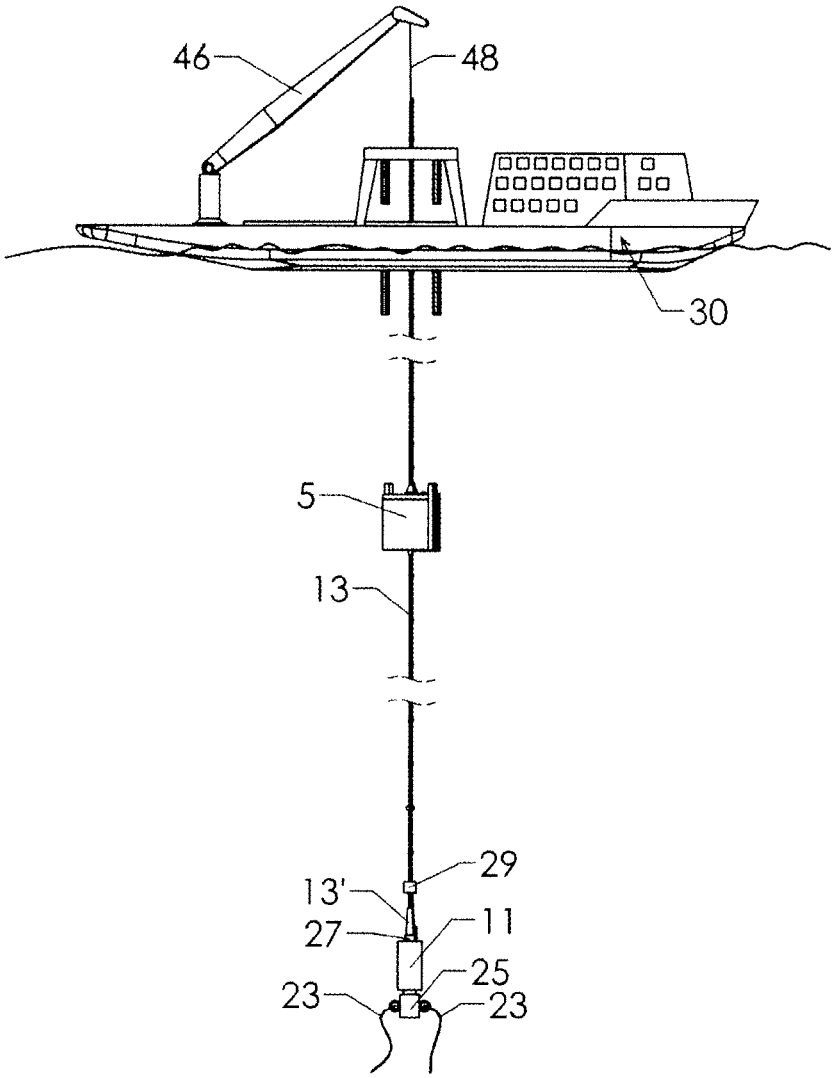
FIGS. 6, 6A, and 6B are schematic views of a riser in stages of assembly, FIG. 6B showing the completed riser before landing on a tree or mooring to an anchor.
Figure 6A:
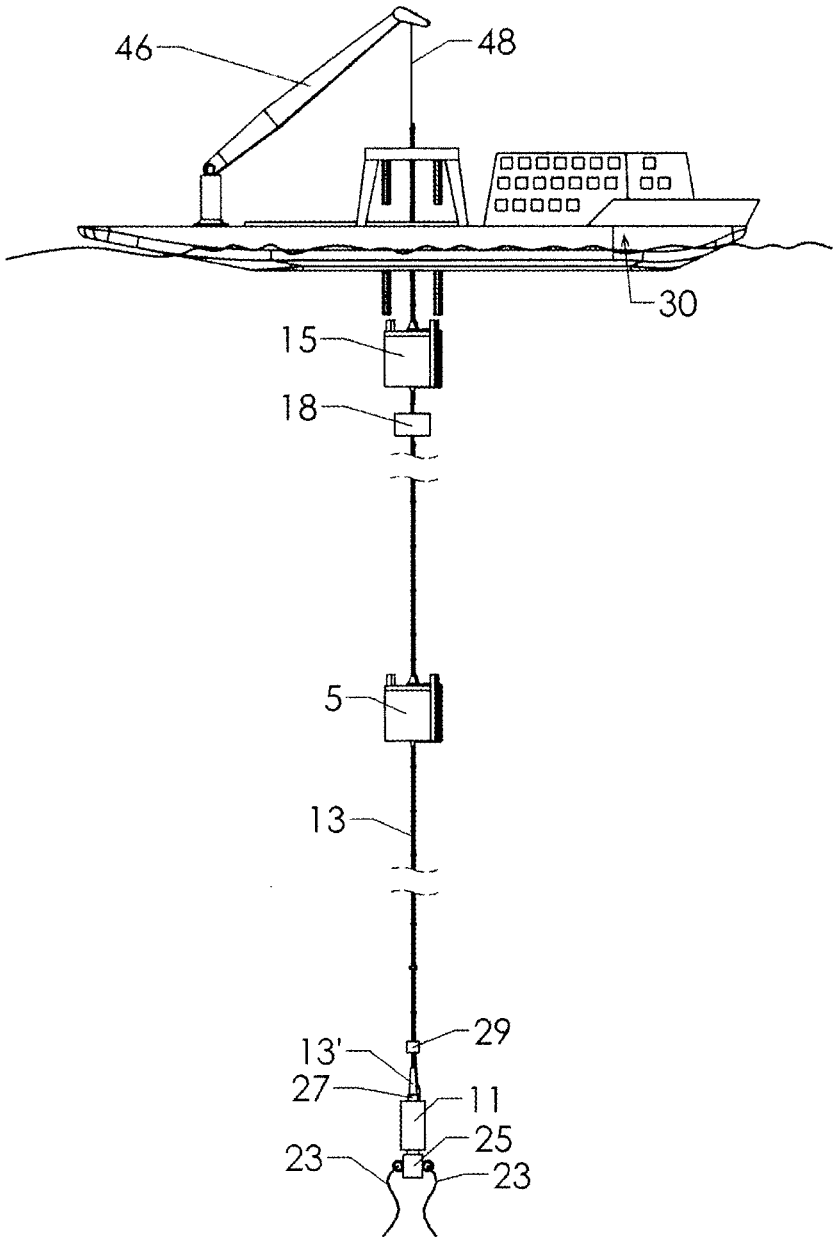
Figure 6B:
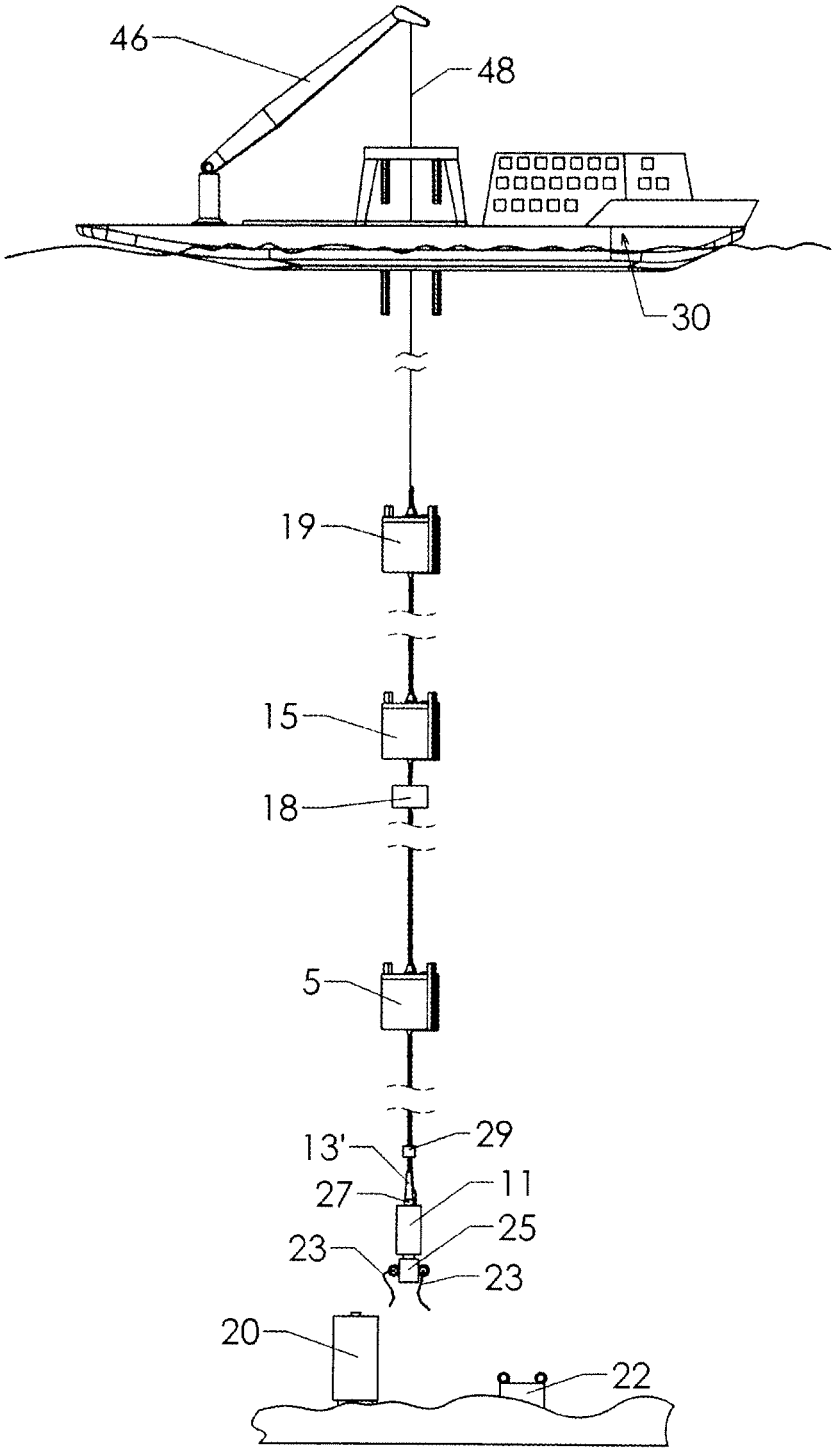

Referring now to FIGS. 6, 6A and 6B, a typical sequential assembly of a riser 10 is shown:

Installation Methodology Including Key Procedure Steps

1. Assemble Seafloor Shutoff Device (SSD) 11 with its lower end engaged to mechanical connector 25. Connect the control umbilical 12 to the assembly, lower the assembly through the moon pool, and hang it off from the moon pool cover.
2. Assemble specialty joints 13' to the previous joint(s) and hang off this segment of riser through moon pool. Deploy reeled umbilical 12 at same rate as assembled joints are lowered.
3. Lift additional specialty and standard joints 13 to vertical and set on top of assembled segment of riser and attach. Sequentially connect joints to the assembly, secure the umbilical to the joints as required, and lower the assembly one joint at a time by lifting the assembly from the hanger in the moonpool cover and lowering it.
4. Run a specialty joint with buoyancy before the suspended weight reaches the load limit of the lifting device, preferably crane 46. Lower riser & engage guides of buoyancy module specialty joint 5 with guides in moonpool.

5. Vent the buoyancy module through the umbilical if necessary to keep the deployed riser assembly heavy in water as the buoyancy module goes through the moon pool, and then, as joints are added and the assembly is lowered, avoid high hook loads by de-ballasting deployed buoyancy module(s) by supplying compressed gas through the umbilical to maintain desired buoyancy. The lift being provided by each buoyancy module can be measured by tension sensors 24 (see FIG. 1D) above and below the module. The sensors 24 are preferably similar to strain gages or load cells. Alternately or as backup, water level sensors in the buoyancy modules can be used to calculate buoyancy.
6. A specific embodiment of the riser 10 following the above steps is illustrated in FIG. 6B wherein joint 13' and segment 13 are connected to the top of buoyancy module 5 and extend up to and connect to a specialty joint 18 which incorporates selected blowout preventer functions. As per the steps above, joint 13' and segment 13 are connected to joint 18 and additional mid-water buoyancy module 15 can be added to the assembled riser. Additional joint 17' and segment 17 are raised and connected above buoyancy module 15 until the near-surface module 19 is assembled to the riser 10.
7. Lower the assembly on a lowering line 48 till the lower end of the riser approaches the tree, mooring location, or other element of seafloor infrastructure. Alternately, with sufficient line length, the constant tension winches used to tend the guide wires can be used to lower the riser for soft landing on the desired element of seafloor infrastructure.
8. Trim buoyancy as appropriate for mooring or for soft landing on tree or anchor. Performance demands on the heave compensation system of the lowering device, such as crane 46 or the winches that tend the guide wires are reduced by using buoyancy to support much of the weight of riser 10 so that a high mass, low weight load is suspended from the lowering device.
9. An ROV can be deployed from vessel 30 or a supporting vessel to assist in aligning the riser 10 over the intended tree 20 or a mooring anchor 22 and assist in operation of the connection 25 or the mooring line(s) 23 (see FIG. 6B). When desired, the fully assembled SSR may be "parked" on a mooring anchor 22. Vessel 30 or another vessel which is not necessarily equipped for riser assembly can relocate the fully assembled SSR from a parked position to an intervention location such as a tree or wellhead, or relocate the fully assembled SSR from one intervention location to another.
10. Secure the riser to the tree or mooring anchor.
11. Load test by tensioning riser. This may be done by trimming buoyancy to make the riser slightly heavy and using lowering line(s) to load test, or by moving vessel aside and supplying gas, preferably through the umbilical, to increase buoyancy for load test of the riser. In either case, buoyancy of individual modules is trimmed so as to demonstrate the structural integrity of the entire riser without applying undesirably high tension to any location of riser 10.
12. Trim the buoyancy to nominal for survival. This value may vary depending on water depth, buoyancy module elevations, anticipated current, riser self weight and content of SSR, and other conditions that vary from one SSR/application to another.
13. Pressure test the SSR to a suitable multiple of the highest internal pressure it may see in service to verify that field-made joint connections do not leak and are structurally sound.

At any point in the installation sequence a buoyancy module specialty joint can be attached to the top of the partially assembled riser and de-ballasted and the assembly released to float in the sea. Connecting a wire rope, soft line, or chain from the riser to an anchor 22, such as a suction pile prevents the assembled riser 10 from drifting. The mooring line can hold the SSR down so that its top is below ship traffic and surface waves.

The shutoff device 11 and connector 25 described above constitute a heavy weight that is suspended from the riser as it is deployed. This weight rests on the tree or wellhead 20 after the riser is landed. This transfer of weight simplifies transition of the riser from heavy in water (for installation) to the buoyant condition necessary for the riser to be self supporting. Because the weight transfer is substantial, the SSR can be conveniently landed for connection to the tree or wellhead 20 without allowing the lower riser joints to go into potentially damaging compression. The weight transfer also helps mitigate any concern that a buoyant riser might float up and strike the ship if the connector 25 to the tree or wellhead does not fully engage and lock.

Figure 7:
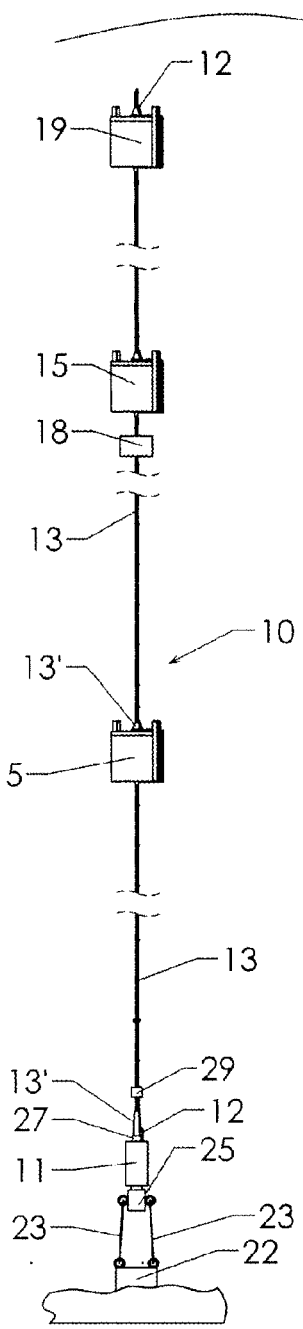
FIG. 7 is a schematic view of a riser moored to an anchor.
Figure 7A:
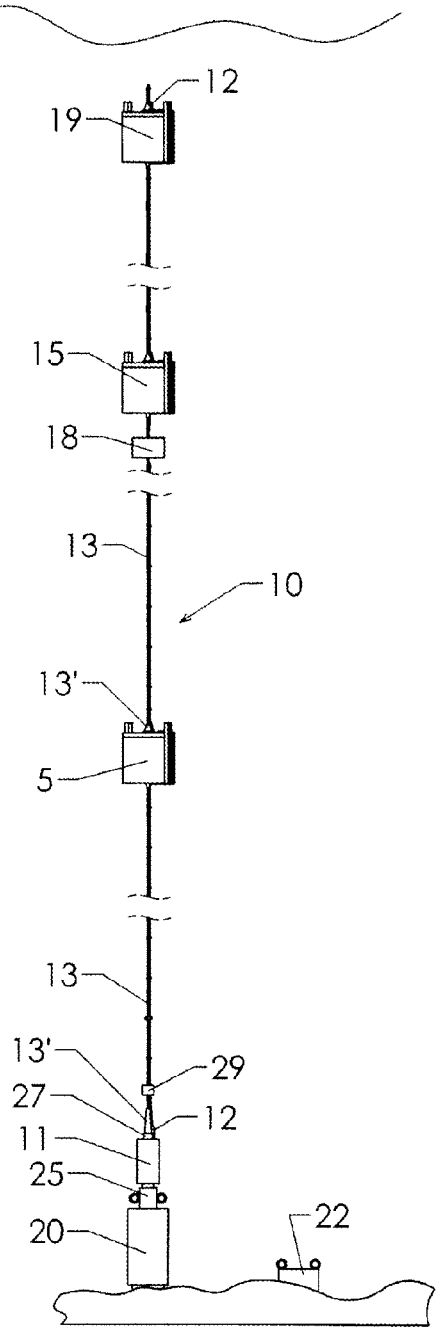
FIG. 7A is a schematic view of the riser connected to a tree.

Referring to FIGS. 7 and 7A, it is clear that the riser may be positioned either on an anchor 22 or a tree or wellhead 20. The choice depends in part on the time span and the conditions under which the riser is to be left before a service/intervention vessel will commence operations. An advantage of using the anchor is there is no stress on the tree or wellhead and no bending or fatigue in the lower part of the riser while the riser is moored. When a service/intervention vessel arrives it can move the riser from the anchor to the tree or wellhead 20 using either a crane line or the RVI (discussed in more detail hereinafter). The unique riser 10 of whatever configuration is then ready for service, which may include downhole intervention, well testing, production, or other service.

Removal

Provisions for removal (recovery) of the SSR are included in the design of the riser and the configuration of the installation vessel and equipment. Hence, the same vessel 30 can be used for installation and removal. Installation steps are reversible with few exceptions, such as load test is not needed during recovery, and guide wires are needed for recovery of large diameter specialty joints such as buoyancy modules but not needed for SSR installation.

Again referring to FIGS. 7 & 7A, to move or recover riser 10, line 48 of crane 46, is engaged to the top of the SSR, buoyancy is ballasted to make the SSR heavy in water, the connector 25 is released from the tree or wellhead 20 or moorings are released from anchor, and SSR is lifted by the line 48. Gas is vented from the buoyancy modules as necessary to prevent buildup of pressure across the hull of the module. When the top of the SSR approaches the surface for recovery, guidelines arc established between the near-surface buoyancy module 19 and the guide rails 37, the module is pulled up through the moon pool 36, and the installation procedure is reversed. After recovery, each modular specialty and standard joint of the riser can be inspected and returned to a pool for future use in assembling other risers.

During either installation or retrieval, a buoyancy module can be attached to the top of any joint and the riser can be lowered, moored, de-ballasted, and abandoned until the contingency (such as deteriorating sea state or vessel problem)

has passed and operations can resume. This makes it practical to secure and abandon the riser without completing the installation or removal sequence.

Vessel Configuration

The present invention includes a novel configuration for an SSR and a novel outfitting configuration for a small vessel, perhaps 200 to 300 feet in length, outfitted for SSR installation and recovery in surface conditions that would otherwise not permit such installation or retrieval operations. Advantages include shorter installation time, smaller crew, lower day rate, and better access to harbors for mobilization.

The configuration of vessel 30 has one or more of the following systems and features for SSR installation or recovery, including:

- Provisions for transferring joints and handling them on deck
- Integrated system for lifting, aligning, and connecting joints
- Gantry or other lifting device to acquire next joint & position it over previous joint
- Handling aids to stabilize suspended joints against motions of a small vessel subject to high motions
- Automatic positioning of next joint in tooling that engages the connection
- Joint connection tools integrated with moonpool cover or retractable work surface to save steps in running each joint
- Lift system rated to lift the heaviest specialty joint in air while it is attached to submerged riser joints
- Provisions to transfer joints to/from supply vessels or barges
- High volume compressed gas supply
- Provisions to deploy or recover umbilical as riser joints are lowered or raised
- Suitable moonpool near vessel center of motion with guides for large diameter specialty joints
- Constant tension winches for tending guidelines used when lowering and recovering large diameter specialty joints via the guides in the moonpool
- Retractable moonpool cover or platform that serves as a floor/work surface for joint connection
- Novel arrangement of tools for more efficient joint connection
- Support equipment suitable for lifting and aligning casing joints for assembly
- Provisions for handling joints during the high vessel motions inherent with small vessels
- Winches positioned to tend tag lines during lifting of joints and specialty joints
- Heave compensated or constant tension lift for lowering SSR and securing it to a tree or wellhead Referring to FIG. 7A, the uniqueness of the SSR 10 is illustrated by preparation of the SSR for downhole intervention, using coiled tubing, drill pipe, or wire line tools. It is understood that the SSR illustrated is only one embodiment of the present invention and that many combinations of specialty joints, including number of buoyancy modules and other specialty joints will permit a large number of embodiments and can allow the SSR to serve functions other than downhole intervention.

Vessel Configured for Downhole Intervention

The present invention includes a novel configuration for a small vessel, perhaps 150 to 300 feet in length, outfitted for downhole intervention though a self standing riser in surface conditions that would otherwise prevent operations from being carried out by a small vessel subject to high heave, pitch and roll motions. Advantages include a lower cost vessel, smaller crew, lower day rate, and better access to harbors for mobilization. The present invention solves the necessary riser and vessel interface to allow downhole operations from a small vessel.

Figure 8:
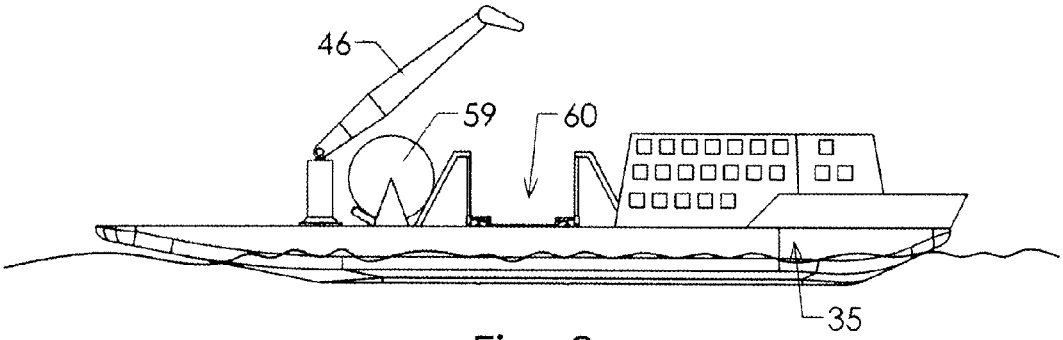
FIG. 8 is a schematic view of a novel vessel configuration for down hole intervention.
Figure 8A:
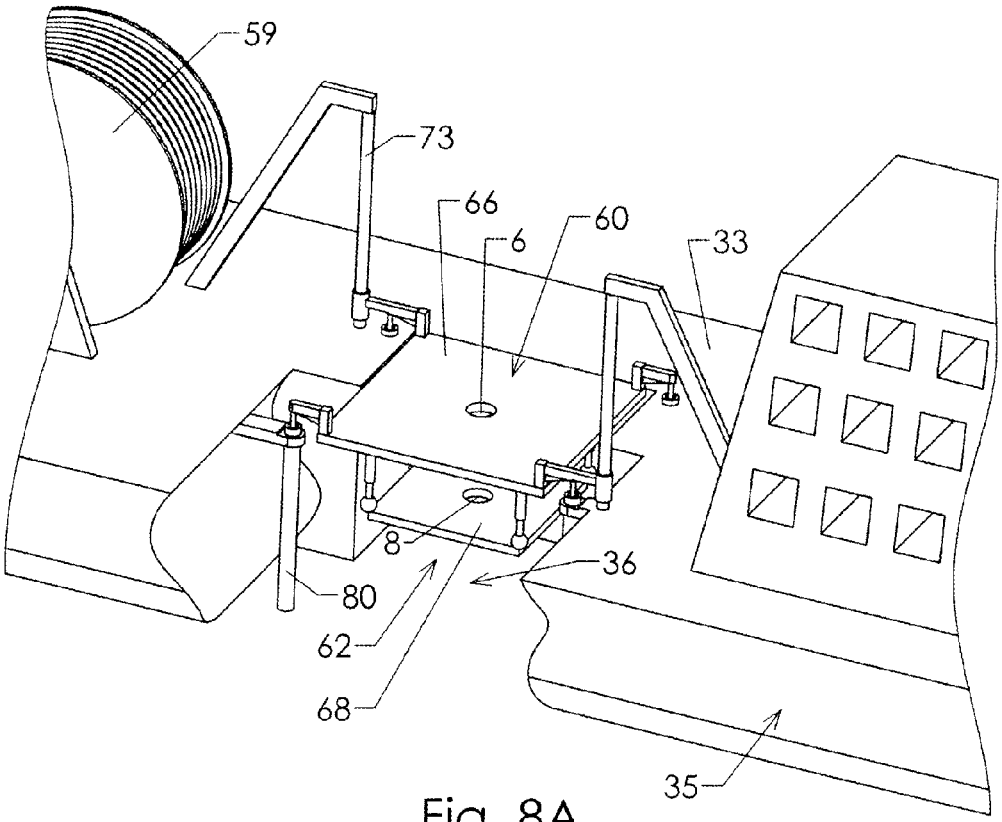
FIG. 8A is a top isometric view of the vessel configuration with one embodiment of the stabilization system over and in the moon pool for down-hole intervention.

Referring now to FIGS. 8 and 8A, a vessel 35, differing over vessel 30 in the way it is outfitted, but having similarities such as having a moon pool (which may be smaller than for vessel 30). The major differences are that vessel 35 has: 1) a Riser Vessel Interface System 60 and 2) a reel 59 having either coiled tubing and/or wire line; and additional equipment for the coiled tubing or wire line for downhole intervention.

Riser Vessel Interface System

A novel Riser Vessel Interface System (RVI) 60 facilitates using the SSR for downhole intervention and workover through the SSR using relatively small vessels. The nature of an SSR is such that it tends to be relatively sensitive to the magnitude of externally applied tension and to variations in externally applied tension. It is the nature of small vessels that their motions in response to waves and swells are greater than those of larger vessels and substantially greater than the motions of platforms or floating production facilities. The interface between an SSR and a small vessel therefore requires a greater range of motion and less tension variation than is provided by the previous art. The coiled tubing injector must also be isolated from vessel motions, and the weight of deployed tubing normally hangs from the injector. Contingency situations, such as parting of the deployed tubing or slippage of the tubing with respect to the injector could result in sudden load excursions much greater than the SSR can tolerate. The subject RVI provides a practical interface between an SSR and any size vessel adequate to provide required operational support for downhole intervention using coiled tubing and has adequate range and sophistication of control to ensure the practicality of coiled tubing work from a small vessel.

The RVI 60 includes a Stabilization System 62 that is mounted on the vessel and a Riser Extension 64 that attaches to the top of an SSR. An object of the present invention is to provide a riser extension that can be secured and held in tension by a stabilization system supporting equipment and secured to a vessel that is subject to all 6 freedoms of movement, including heave, pitch and roll.

The RVI System 60 described herein enables a vessel much smaller than a typical deep water MODU to maintain tension in a riser extension connected to an SSR and support the weight of equipment above the riser extension while the riser extension and everything mounted above it remain essentially fixed with respect to the earth and the vessel is free to move in pitch, roll, and heave and has a reasonable range of freedom in yaw, surge and sway (position). Thus all six degrees of vessel freedom are accommodated while the vessel maintains structural engagement to the riser extension. This method and apparatus are of particularly high utility when a vessel subject to high motions is interfaced to a Self Supporting Riser (SSR) 10 that is attached to hydrocarbon production architecture (equipment) founded at the seafloor in the open ocean. The SSR is assumed to be similar to that described elsewhere herein. The RVI System 60, as stated above, consists of a stabilization system 62 and a riser extension 64, which will be described in detail hereinafter.

Stabilization System

Figure 9:
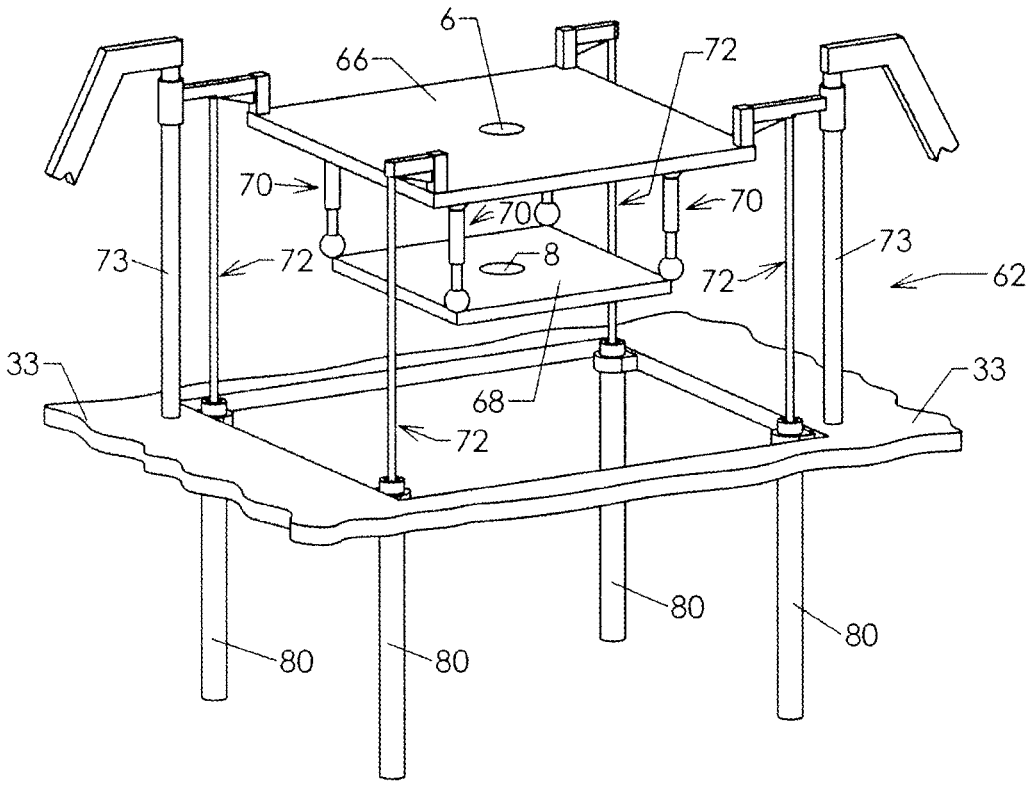
FIG. 9 is an isometric view of the stabilization system, with a cutout of the deck of the vessel.

Referring to FIG. 9, an isometric view of the stabilization system 62 is shown with only a cutout of the deck 33 of the vessel so that the heave, pitch and roll configurations can be more easily explained. The stabilization system 62 comprises a heave stabilized platform 66 and a pitch and roll stabilized frame 68. Frame 68 is shown below platform 66 and held by cylinders 70 (also referred as pitch and roll cylinders). The platform 66 is supported by cylinders 72 (also referred to as heave cylinders) that are attached to the vessel 35. Guide rails 73 (also referred to as heave guide rails) are attached securely to the vessel and prevent binding and racking of the cylinders 72.

It is apparent that stabilization system 62 could be located on a porch extending out past the deck, in a similar manner to that described for location at a moonpool, with the primary disadvantage being greater distance from the vessel center of motion.

Heave Stabilization Configuration

Figure 9A:
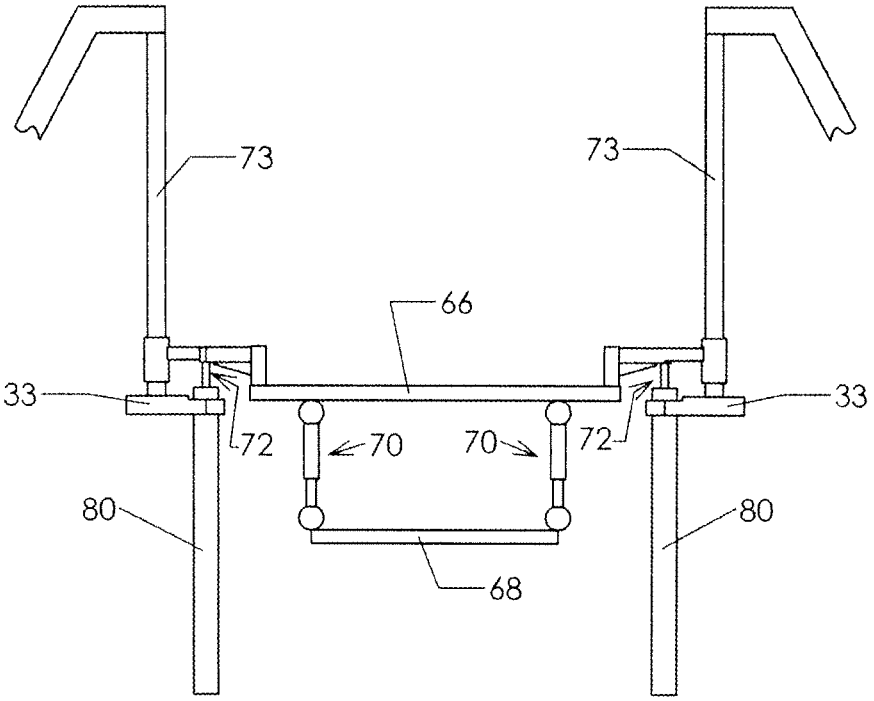
FIG. 9A is a schematic side view of the stabilized heave platform in its lowest position.
Figure 9B:
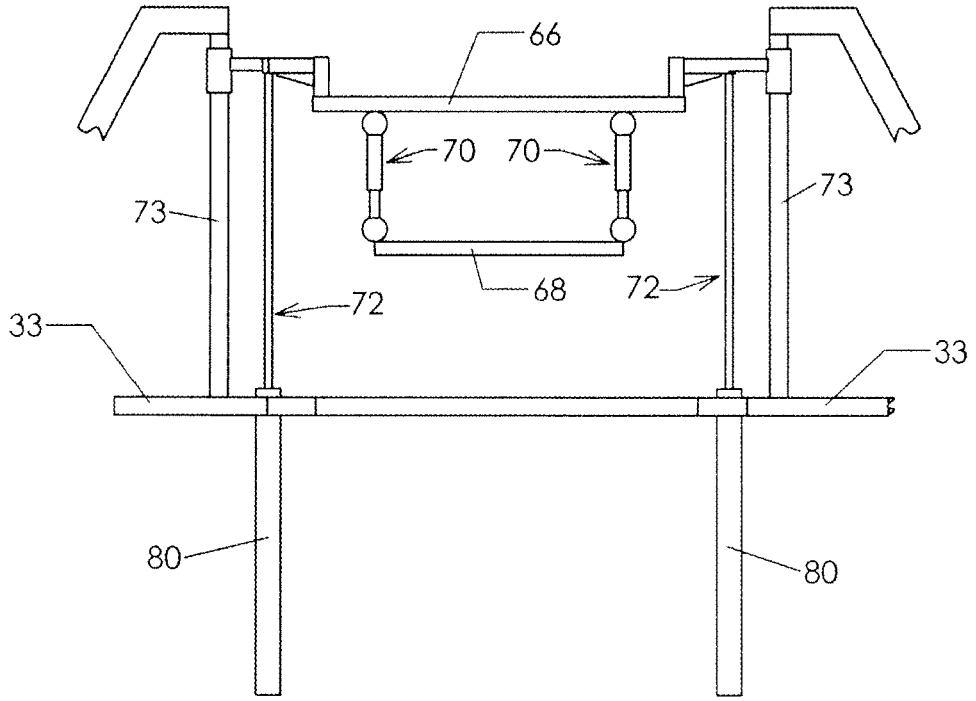
FIG. 9B is a schematic side view of the stabilized heave platform in its highest position.

Heave cylinders 72 are secured to the vessel 35 and mounted to move the platform 66 preferably over or within a moon pool located near the vessel center of motion. Referring to FIGS. 9A and 9B, a heave stabilized platform 66 moves up and down with respect to the deck, but is otherwise fixed to the vessel. FIG. 9A illustrates the platform 66 in its lowest position (vessel and deck up); whereas FIG. 9B illustrates the platform 66 in its highest position (vessel and deck down). The heave stabilization function allows the platform to remain parallel to the deck and to run on guide rails 73 fixed to the vessel. The guide rails 73 brace the platform 66 and cylinders 72 against racking and facilitate spanning a moon pool. The cylinders can be founded, attached, or fixed on the keel structure, a sub-deck, or the main deck. Cylinders can alternately be suspended from the structure that supports the top of the guide rails 73. Cylinders 72 stabilize heave only, so they only move perpendicular to the deck and thus they can be rigidly mounted to the vessel. A frame mounted on the cylinders can have a vertical range of motion as great as the length of the cylinder stroke, which might typically be 20 feet long. Twenty foot long cylinders (for example) would provide +/−10 feet of motion around their mid-stroke.

The system described provides a platform whose elevation with respect to the deck changes to keep the riser extension (herein described below) essentially isolated from vessel heave. Structure attached to and supported by this platform can extend up to any height, and can extend down into the moon pool and below. If the midpoint elevation of the platform is above the vessel center of motion, structure attached to the platform and extending down to near the vessel center of motion elevation can provide a preferred location for mounting pitch and roll stabilization apparatus.

Hydraulic Support and Control for Heave Stabilization

Hydraulic heave cylinders 72 are sized so that the maximum load divided by the combined cross sectional areas of all cylinders is a reasonable pressure, typically between 3000 and 6000 psi for commonly available hydraulic components.

There can be any number of heave cylinders 72, provided that there are suitable provisions to coordinate their movement and prevent binding. These provisions may include measures such as locating the cylinders so that they are suitably arrayed around the center of load and preferably running the platform on guides as shown in FIGS. 9A and 9B. For simplicity of control, there is preferably an even number of cylinders arranged symmetrically around the nominal center of load and arranged such that for any straight line drawn through the nominal center of load and parallel to the deck, an equal number of cylinders are symmetrically arrayed on each side of the line. The hydraulic cylinders go up and down together so long as binding is prevented by guide rails or other provisions such as load balancing and suitable design of the hydraulic system.

Figure 9C:
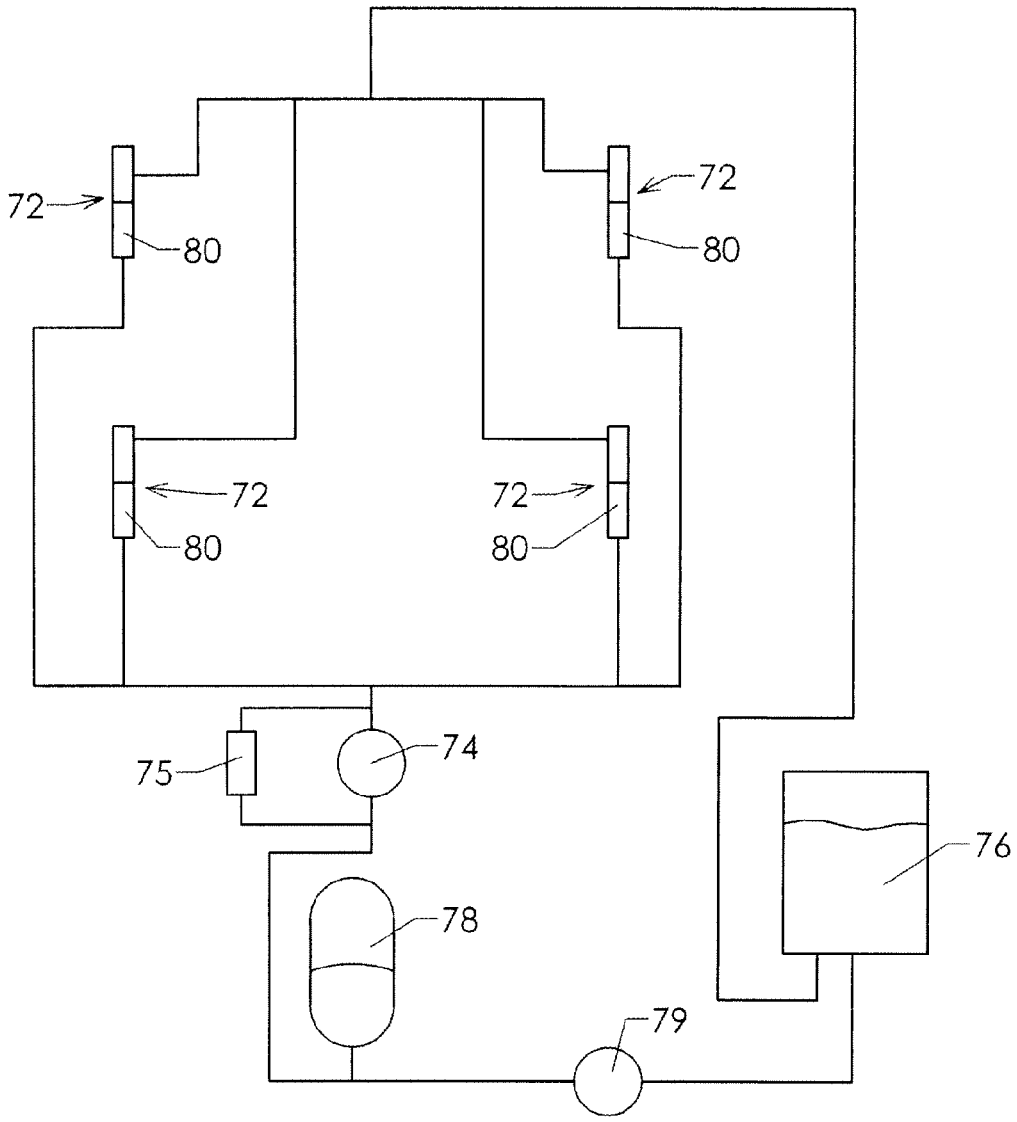
FIG. 9C is a schematic diagram of a hydraulic system for the heave platform.

A suitable four cylinder hydraulic circuit is shown diagrammatically in FIG. 9C. In this arrangement fluid for the lower chambers of the heave cylinders 72 is supplied by a pump 74 and reverse circulation flows through component 75. A reference signal can be derived by measuring tension in the riser extension, directly or indirectly. If riser extension tension drops below nominal, as for instance when the vessel heaves down, the pump delivers fluid to the lower chambers 80 of the cylinders to extend the cylinder rods to maintain upward force on heave platform 66. If riser extension tension increases, as for instance when the vessel heaves upward, flow regulating component 75 allows fluid to return from the load bearing chambers 80 of the cylinders to accumulator 78 or to reservoir 76 if accumulator 78 is not used, thereby maintaining nearly constant pressure in the cylinders and nearly constant tension in the riser extension.

When energy conservation is important, the pump draws fluid from and returns fluid to a sealed reservoir, i.e. an accumulator 78. Sealing and pressurizing the accumulator 78 reduces the load on the pump 74 by reducing the pressure across it. Thus the pump only needs to transfer fluid across the pressure differential between the accumulator 78 and the load bearing chambers 80 of the cylinders 72 and the pressurized reservoir reduces the energy required to operate the pump 74. Active control of the pressure in the accumulator via an accumulator charge pump 79 and associated valves (not shown) helps limit the range of this pressure differential when there are sustained changes in the load on platform 66.

Pump 74 is normally controlled by a signal derived from direct or indirect measurement of tension in the riser extension so that the pump functions to maintain constant riser extension tension. Automatic pump controls can be on/off, but preferably are proportional to an error signal based on the difference between desired riser extension tension and measured riser extension tension. For closed loop control, for instance, the reference can be compared to negative feedback from riser extension tension sensors to generate the error signal. Alternately, control can be derived from accelerometer (s) fixed to the vessel, and tension in the riser extension can be used as the feedback signal with an inner loop based on comparison of mean extension of the rods of cylinders 72 to keep the range of operation essentially centered around the mid-extension of the cylinder rods. A control system that causes pump speed to be greater when the error signal is large (and small when the error signal gets smaller) facilitates a stable control system and helps minimize variations in tension. Pressure regulating or bidirectional pressure relief or bypass valves 75 across the pump 74 facilitate temporary operation on accumulator pressure alone in the event of pump failure. Variations in riser extension tension are larger if pump function is lost, so redundant pumps and provisions for high reliability are incorporated. Provisions to continue function after the failure of a hydraulic cylinder or other component generally work better with an increased number of cylinders.

Riser tension can be measured directly by strain gages, load cells, or other load monitoring devices. Alternately or as backup, riser tension can be measured by measuring pressure in the fixed volume of hydraulic fluid that is common to the load bearing chambers of the pitch and roll cylinders, converting the value to force, and subtracting the weight of the equipment mounted on the RVI. A reference signal derived by this approach can alternately be used to control pumping to the heave stabilization cylinders to maintain constant riser tension.

In circumstances such as when the riser extension is not engaged to the SSR or in the event of failure of the tensions sensors, control of the heave cylinders can be transferred to a signal derived from a combination of accelerometer sensing of vessel heave and sensing of extension of the heave cylinder rods.

Any number of heave cylinders can be used. For simplicity of control, an even number is preferably arrayed symmetrically around the riser extension. For enhanced reliability through redundancy there can be two sets of heave cylinders. Both sets can share the load under normal circumstances, but each set of cylinders is adequate to support the full load without support from the other set. Each set has its own hydraulic power and control system. In the event that either set of cylinders fails to support its share of the load, the hydraulic fluid already in the other set will immediately take the load and the tension error signal will cause the associated pump to continue to deliver the appropriate volume of fluid to maintain constant tension in the riser and riser extension. This is a major advantage over gas charged systems in which the displacement must change in order for a cylinder to assume more load. There are also provisions to lock out either set for maintenance while the other set continues to function.

Pitch and Roll Stabilization Configuration

Tension in the riser extension (which is discussed in more detail elsewhere herein) is provided by the vessel through the stabilized frame 68 and mechanisms which allow the vessel to pitch and roll with respect to the earth while maintaining steady tension in the riser extension.

Figure 9D:
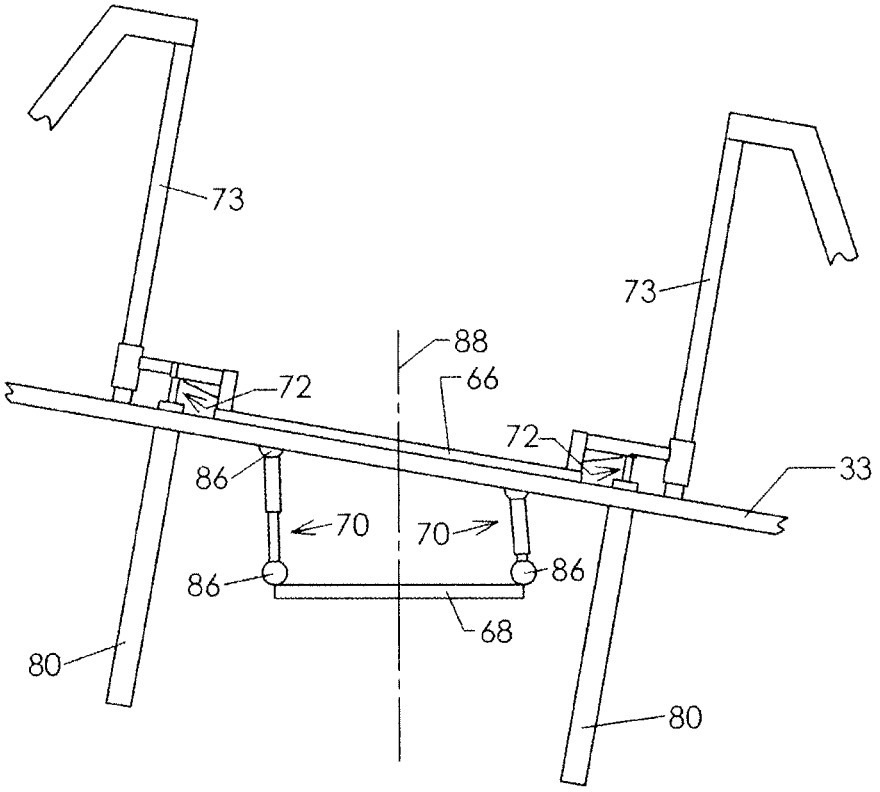
FIG. 9D is a schematic side view of the stabilized pitch and roll frame in one position.
Figure 9E:
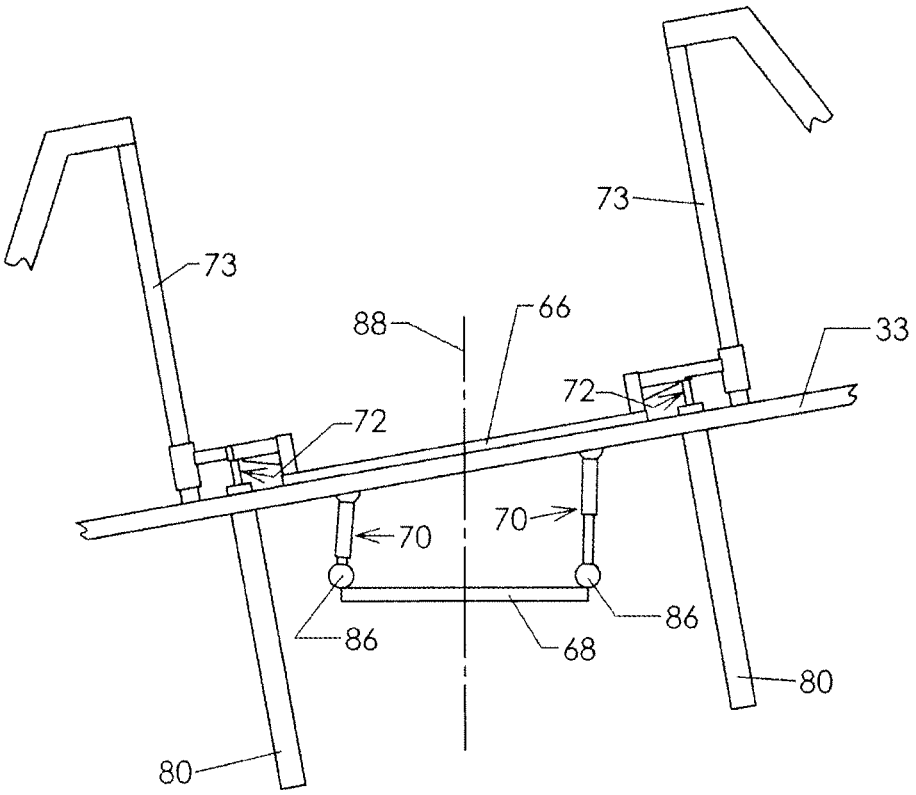
FIG. 9E is a schematic side view of the stabilized pitch and roll frame in the opposite position as FIG. 9D.

Referring to FIGS. 9D and 9E, the load bearing pitch and roll stabilization cylinders 70, are connected between frame 68 and heave platform 66. These cylinders 70 are attached by pivots 86 at their ends to accommodate the changes of alignment of the pitch and roll cylinders 70 with respect to both the riser and the vessel as the vessel pitches and rolls. The range of compliance of this attachment must be adequate for the desired range of pitch and roll stabilization. Beyond this range, structural restraints (not shown) limit the range of inclination of these cylinders to prevent racking due to rotation of either the riser or the vessel (yaw) about the vertical axis of the riser extension held by the stabilized frame 68. Forces to create racking may be expected during changes of vessel heading.

Placing the pitch and roll cylinders each two feet from the centerline 88 of the riser extension allows a plus or minus nine inch stroke to compensate +/−20 degrees of pitch or roll. A longer stroke would accommodate even greater pitch and roll angles, readily providing more than an order of magnitude improvement over prior art. If the cylinders are 2 feet long the rod can move about one foot up or down from the center position, which can compensate for about 26 degrees of pitch or roll. Longer cylinders or mounting the cylinders closer to the centerline of the riser extension would accommodate larger pitch and roll angles, and vice versa. By the geometry of similar triangles it can be seen that for a desired range of pitch and roll stabilization the cylinders must be made twice as long if they are located twice as far from the riser extension, three times as long if they are 3 times as far away, etc. Choice of cylinder location and the number of cylinders keeps cylinder diameter within the available and practical range.

The load path for tensioning the riser extension and for supporting other stabilized equipment is thus from frame 68 through the pitch and roll stabilization cylinders to the heave stabilized frame and through the heave stabilization cylinders to the hull of the vessel. Upward force from the cylinders maintains tension in the riser extension. Locating the engagement devices and pitch/roll stabilization cylinders near the vessel center of motion minimizes relative motion and helps reduce bending moments in the riser extension and reduce non-vertical loads in the Riser/Vessel Interface (RVI) system.

Hydraulic Support and Control for Pitch and Roll Stabilization

Referring to FIGS. 9D and 9E, the pitch and roll stabilization hydraulics can consist of an array of hydraulic cylinders 70 either suspended from as shown or mounted above the heave stabilized frame 66 and arrayed around the riser extension which passes though the opening 8 in stabilized frame 68 and opening 6 in stabilized platform 66, preferably near the vessel center of motion.

Alternatively, the pitch and roll cylinders 70 may be inverted with their cylinder ends (rather than their rods) attached to frame 68. If cylinders 70 are mounted above platform 66 the trapped fluid must always act to prevent shortening the average extension of cylinders 70. If cylinders 70 are suspended from platform 66 the trapped fluid must always act to prevent increase of the average extension of cylinders 70.

Figure 9F:
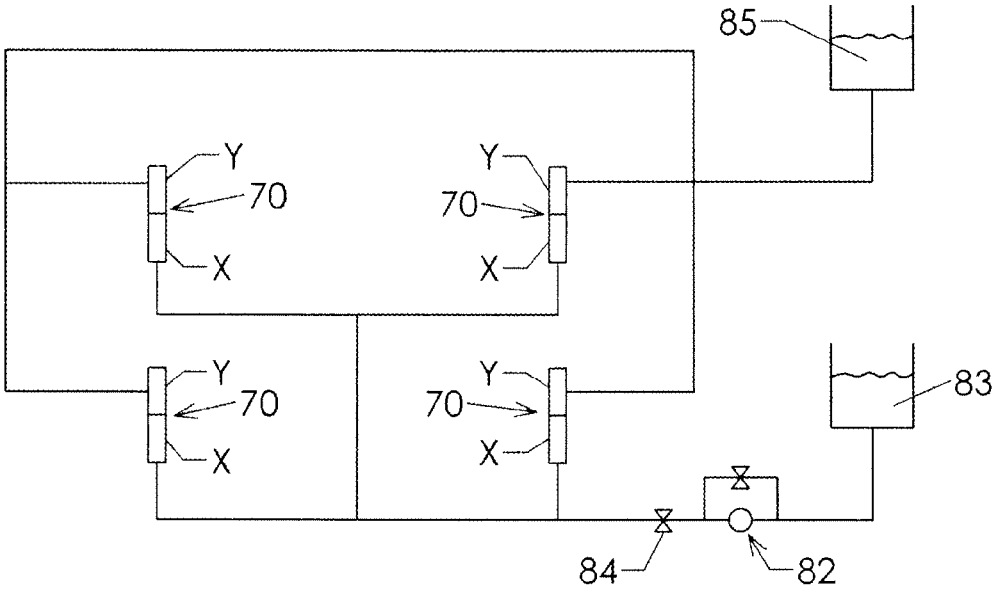
FIG. 9F is a schematic diagram of the hydraulic system for the pitch and roll frame.

In normal operation, tension in the riser extension and the weight of other equipment on the frame creates hydraulic pressure in the load bearing chamber of the cylinders 70. Pitch and roll stabilization can be accomplished by interconnecting these load bearing chambers and trapping a fixed volume of fluid which they share freely. Referring to FIG. 9F, each cylinder 70 has a load bearing chamber X and a non-load bearing chamber Y. Pump and valve assembly 82 removes hydraulic fluid from reservoir 83, with valve 84 open, to fill the load bearing chambers X of the cylinders 70 to a desired volume and to transfer fluid back to the reservoir when necessary. The cylinders arc then isolated from the pump by valve 84. Then each cylinder rod can extend so long as other cylinders retract a corresponding distance so that the average extension of all cylinders does not change. Adequate fluid flow for the unloaded chamber of each cylinder can be provided by connection to reservoir 83 or a second reservoir 85.

When the vessel begins (for instance) to pitch up at the stem or aft (see FIGS. 9D and 9F, cylinders 70 are illustrated as bow to right and aft to left), the load on frame 68 shifts aft, and the uneven load causes fluid to flow from the aft cylinders to the forward cylinders 70. Because the load bearing chambers of cylinders 70 are connected, fluid freely flows from the more heavily loaded chambers to the less heavily loaded cylinders. Thus the extension of each cylinder changes until the load is evenly shared. It is understood that since the illustrations are in two dimensions, this fluid flow due to vessel movement may be from one, two, or three cylinders at once (responding to simultaneous pitch and roll) so that the one or more remaining cylinder(s) must accept fluid to equalize the pressure, and this cannot be illustrated clearly in two dimensions. Since the riser has an essentially vertical axis from the surface to the seafloor, and the vessel is positioned essentially over the riser, the bending moments in the riser extension are lowest and it is held vertically when the load is evenly distributed. This arrangement thus allows the vessel to support the riser extension with only low bending moments being introduced into the riser by vessel pitch and roll movements.

Significant changes in tide will result in the mean extension of the heave cylinders to no longer be at the midpoint of their range of motion, thus leaving less range available to deal with extreme vertical excursions of the vessel. This could be compensated by adjusting the attachment point between the riser extension and the stabilized frame 68. The same effect can be achieved by adjusting the volume of fluid trapped on the load bearing side of the pitch/roll cylinders by opening valve 84 and using pump 82 or its bypass valve, thus extending or reducing the average of their extensions. The appropriate design length of the pitch/roll cylinders is then the required range of motion for pitch and roll stabilization, plus allowance for tidal variation, plus margin.

The overall system therefore enables the vessel to maintain nearly constant tension in the riser extension and support the weight of equipment mounted on the riser extension or frame while the riser and equipment remain essentially fixed to the earth and the vessel is free to move in pitch, roll, and heave. Surge and sway are kept within allowable limits by vessel positioning, which is most commonly done by Dynamic Positioning (DP) referenced to the position of satellites, acoustic beacons, or other available references.

The one remaining degree of freedom for the vessel is yaw. It is common practice to keep the vessel headed into seas or weather, which frequently requires a change in vessel heading. A tall riser typically has adequate axial compliance to accommodate vessel heading changes of perhaps 90 to 180 degrees. Heading changes which exceed the compliance of the riser can be accommodated by providing a suitably low friction bearing surface such as a lubricated load ring between the riser extension and the support mechanisms and an adjacent toothed ring gear. The ring gear is centered on the riser extension and preferably located near the elevation of the engagement at the stabilized frame 68. The drive gear is driven to actively manage the relative orientation of the riser extension and the vessel as the vessel changes heading. This assembly can conveniently be integrated into the device that engages the load shoulders on the upper part of the riser extension.

A rotational orientation device such as the ring gear (illustrated herein below) can be controlled automatically or manually. Heading can be sensed by placing a compass directly on the riser extension, or registration marks on the riser extension can be oriented with respect to vessel heading derived from a vessel mounted compass. Global Positioning System signals can also be used for reference and feedback of riser orientation with respect to vessel heading as the vessel changes heading.

Extension from Vessel to the SSR

The top of the SSR is normally located sufficiently below the surface of the ocean so that forces due to wave action and current do not exceed the limits of the riser. Placing the top of the SSR at least 100 feet below the surface avoids classification as a hazard to navigation. A depth of 100 to 200 feet also isolates it from most wind waves, including those generated by hurricanes. In high current locations such as the Gulf Stream it may be necessary to locate the top of the SSR 1000 feet deep or more to avoid the stronger near-surface currents. An intervention vessel 35 having the Stabilization System 62, as described in detail above, positions itself over the top of the SSR at its installed depth and assembles a riser extension 64 (described in detail herein below) between the vessel 35 and the top of the SSR 10 to complete the Riser Vessel Interface System 60 of the present invention.

Riser Extension

Figure 10:
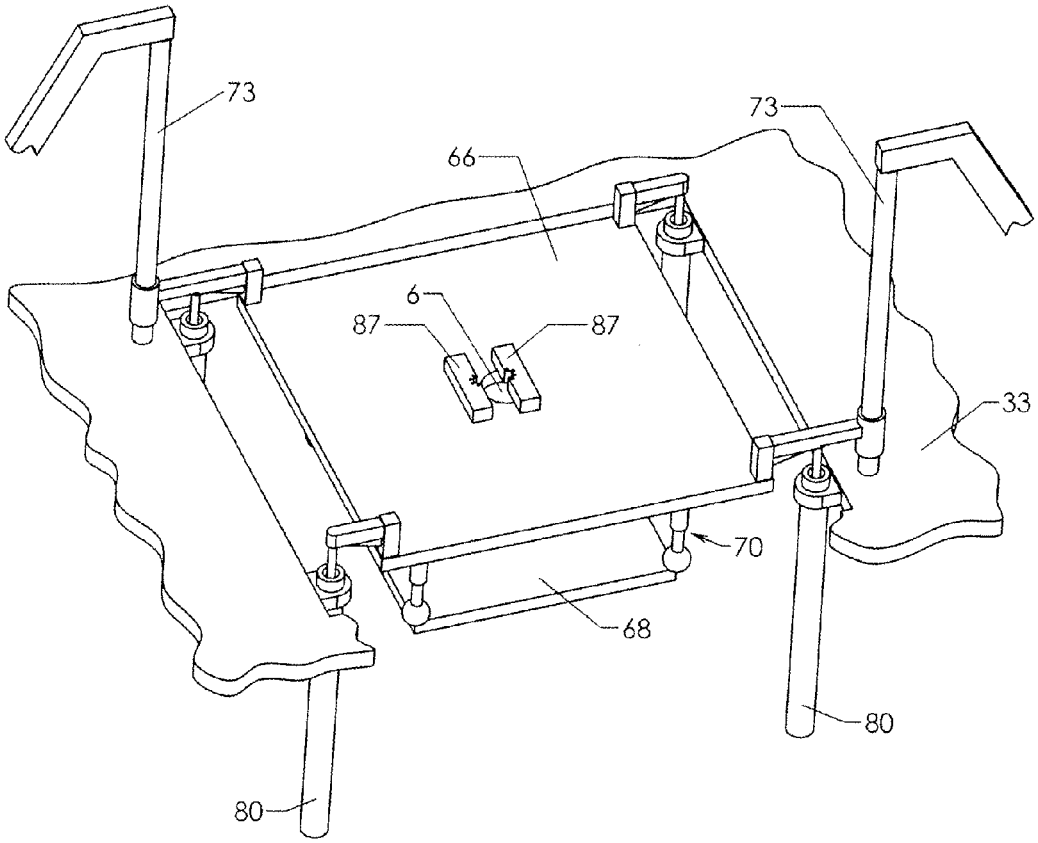
FIG. 10 is an isometric view of the heave platform of the stabilizer system with connecting tools to assemble the riser extension.

The riser extension 64 is assembled on intervention vessel 35 and more specifically the heave stabilized platform 66 of stabilization system 62. Referring to FIGS. 10, heave stabilized platform 66 becomes a work platform. Connecting tools 87 are mounted on either side of opening 6 on platform 66. The tools 87 are movable to two positions one position (open position—left) allows joints to go through opening 6 and the other position (closed position—right) holds the joint connectors on top of the closed assembly. In operation, both tools 87 (right and left) are either closed or open. The steps for assembling the riser extension 64 are similar to those for assembling the riser 10. Riser extension 64 is a plurality of standard and specialty joints 89 that define the riser extension 64.

Figure 11:
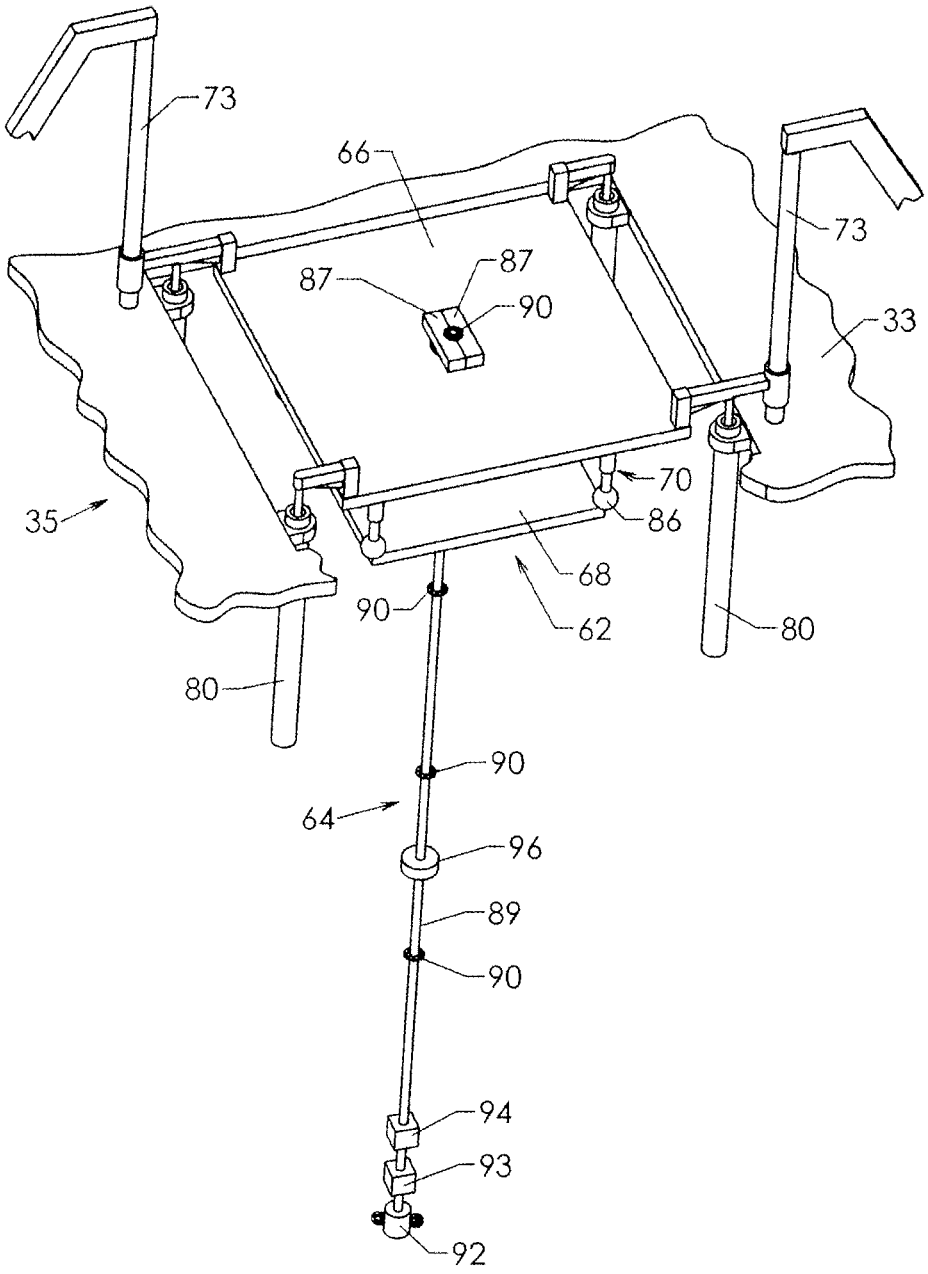
FIG. 11 is an isometric view of the heave platform of the stabilizer system while assembling the riser extension.

Referring to FIG. 11, each standard or specialty joint 89 has a flange, joint connector or enlargement 90 on the end of the joint so that the joint when lowered into opening 6 in platform 66 and opening 8 in frame 68 by crane 46 will seat on the top of the connecting tools 87 when the tools are moved to their closed position. A further joint is lifted with crane 46 and joined to deploy each successive joint. As the riser extension 64 is assembled, joints of differing length can be used to place the attachment of the riser extension near the proper elevation with respect to the platform 66 and frame 68, completing the RVI system of the present invention.

Figure 13:
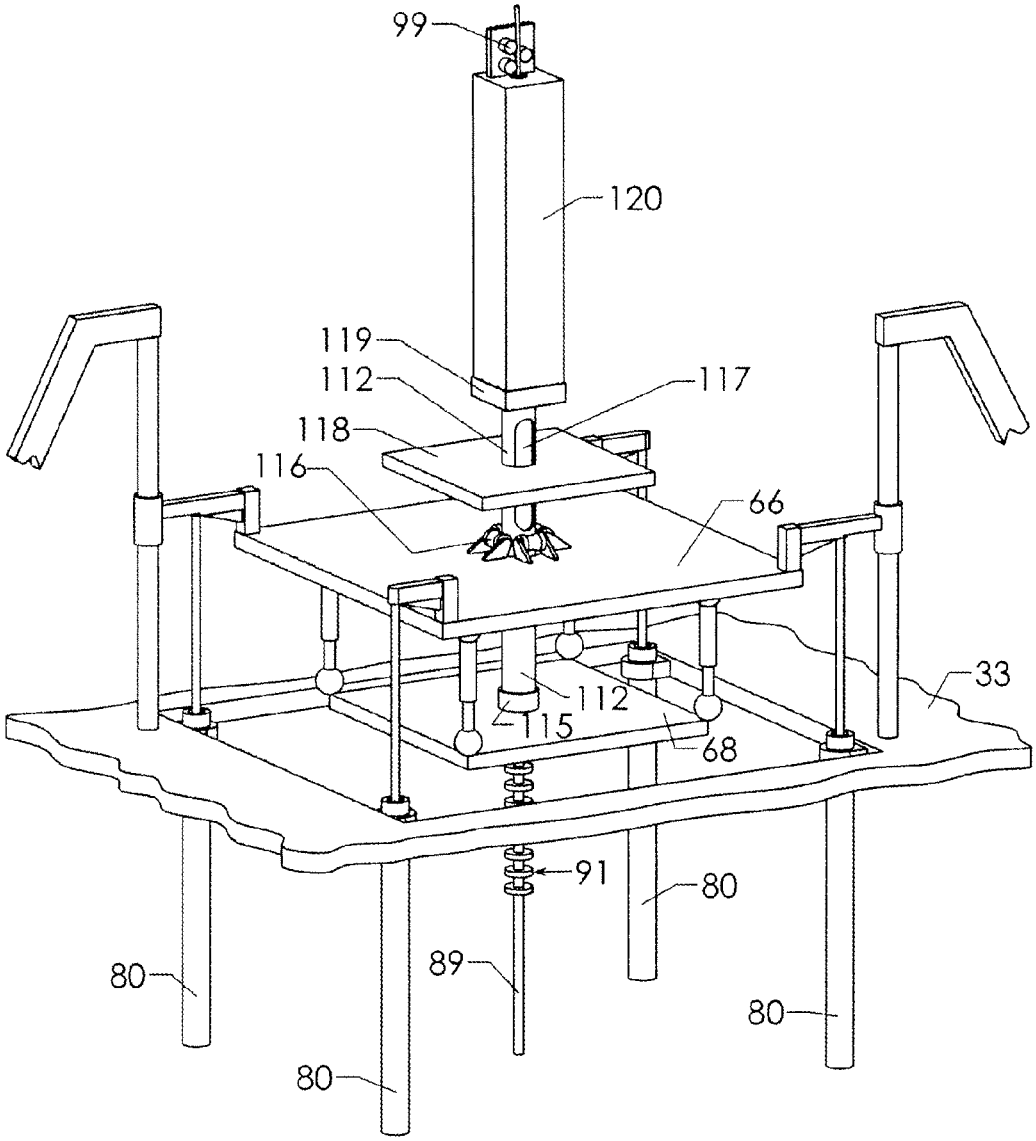
FIG. 13 is a schematic view of the riser interface system with a coil tubing injector above the riser extension.

A preferred embodiment of the riser extension 64 is partially shown in FIG. 11; however, other embodiments will have more or less specialty joints than shown. The lowermost joint 89 includes a connector 92 adapted to connect to the SSR. Above this joint are one or more joints 93, 94 that have selected BOP functions. Joint 93 has an isolation function. These functions may include valve closure, shear, or hang off provisions for tubing or pipe suspended inside the riser. As many as two or more joints may be stacked having BOP functions. Also included is a specialty joint 89 having a tension sensor 96. At the top of riser extension 64 are further joints not shown in FIG. 11, but are shown in FIG. 13 hereinafter.

The vessel 35 is maneuvered to align the riser extension with the SSR connection point. An ROV assists in the alignment between the riser 10 and the riser extension 64, preferably by attaching wires to fittings on the buoyancy module 19, and using the fittings on connector 92, running the wires up to vessel 35, and attaching the wires to winches (not shown) onboard vessel 35. The riser extension is preferably hung from a heave compensated crane 46 or the stabilized platform and the riser extension is lowered to engage and latch connector 92 at the bottom of the riser extension 64 to the top of the SSR 10.

The crane 46 then lifts the top of the riser extension to bring tension in the riser extension to nominal. Multiple load shoulders 91 (see FIG. 13) on the uppermost joint 89 of the riser extension allow the riser extension to be secured to the pitch and roll frame 68 and extend through and above heave platform 66. The riser extension is engaged so that the heave stabilization cylinders are near mid stroke with the riser extension engaged to the SSR and tensioned.

The system will then function as described above, even if the addition of equipment above frame 68 moves the center of gravity for the riser extension and equipment to above the riser extension attachment point.

The riser extension can be disconnected from the SSR and recovered by reversing the above steps.

Method & Apparatus for Deploying CT Through SSR

Figure 13A:
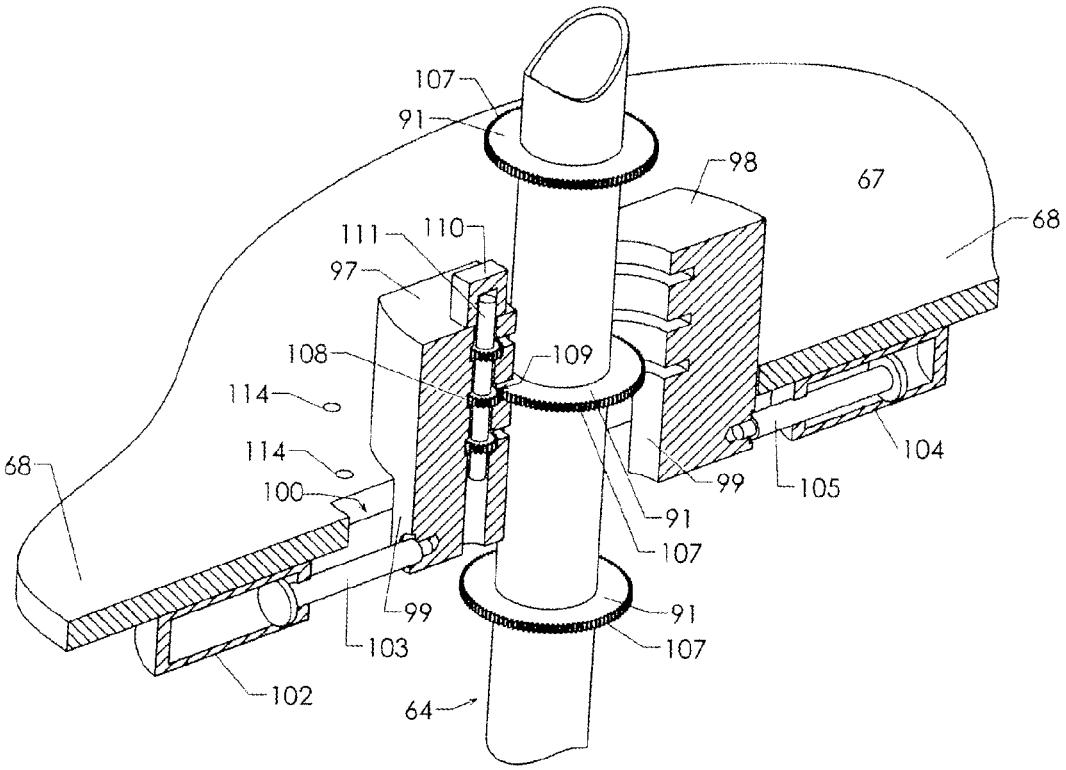
FIG. 13A is an isometric cross sectional schematic view of the interlocking of load rings on the frame of the stabilizer system to the load shoulders on the riser extension and showing provisions for yaw compensation.
Figure 13B:
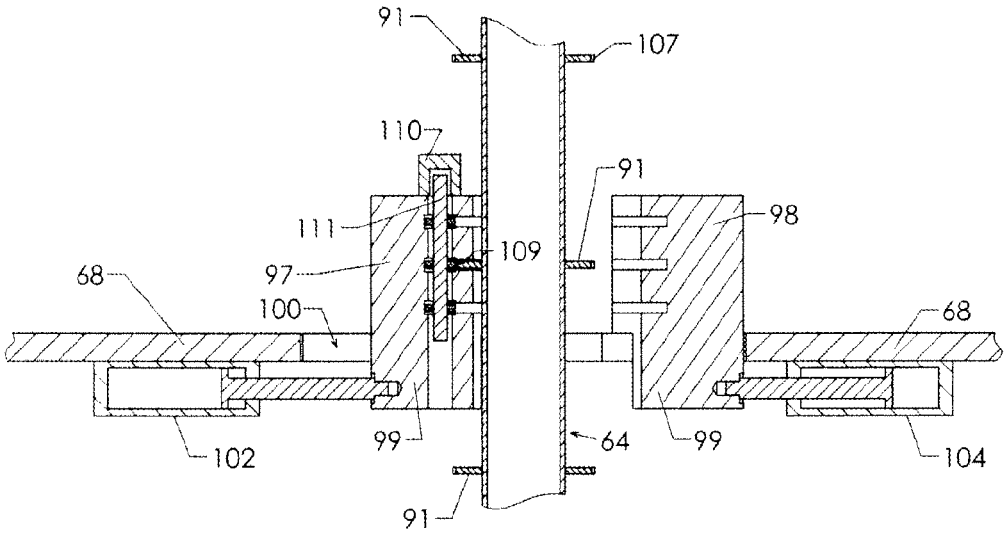
FIG. 13B is a cross sectional schematic view of the interlocking of the load rings to the load shoulders on the riser extension.

Referring to FIGS. 13, 13A, and 13B, a system configuration for downhole operations using Coiled Tubing (CT) or wire line, slick line, or e-line (hereinafter referred to as wire line) through an SSR is shown. The uppermost joint 89 of the riser extension 64 having the multiple load shoulders 91, referred to above, extends above the pitch and roll frame 68 and is engaged by corresponding load-bearing rings or jaws 97 and 98 that move on surface 67 of frame 68, completing the RVI System 60 of the present invention. It is necessary that the point of attachment of the riser extension 64 remain in a fixed elevation with respect to the earth. It is desirable to attach the riser extension near the vessel's center of motion.

Referring to FIG. 13A, jaws 97 and 98 each have a leg 99 that is in a slot 100 through frame 68. Piston 102, attached to the underside of frame 68, has a piston rod 103 attached to jaw 97 and moves the jaw 97 on frame 68 to engage one of the load shoulders 91 on the riser extension 64. Likewise, Piston 104, attached to the underside of frame 68, has a piston rod 105 attached to jaw 98 and moves the jaw 98 to engage the same load shoulder 91 on the riser extension 64. For purposes of illustration, the jaw 97 is shown engaged and jaw 98 non-engaged; however, in operation the pistons will move each jaw either into engagement or non-engagement. On the outer surface of each load shoulder 91 is a toothed wheel 107 which when meshed with another wheel 108 forms a ring gear 109. A motor 110 attached to shaft 111 having wheels 108 attached thereto, provides for yaw movement when the ship 35 changes heading.

Injector Installation

A framework or large diameter pipe 112 having a bottom larger than opening 8 in the pitch and roll frame 68 is lifted by crane 46 and lowered through opening 6 in platform 66 and seated on and secured to the pitch and roll frame 68. The pipe 112 is secured by bolts or other structure such as a cradle 115 on frame 68. Compliant rollers 116 mounted on platform 66 abut framework or pipe 112 to cause the riser extension 64 to follow the vessel as the vessel moves in surge and sway. The pipe 112 can have a large window opening 117, preferably above platform 66, for access to the inside of the Pipe.

Pipe 112 extends up through and above the heave stabilized platform and can have a deck 118 that extends outward of the framework 112 for personnel and equipment. At the top of framework 112 can be a cradle 119 for holding the underside of a coil tube injector 120. The deck 118 provides personnel access to the injector and, through window 117, to tools that can be hung in pipe 112 or the under side of the injector 120.

Deployment Equipment Assembly Methodology

1. Secure riser extension to frame 66 by load rings 97, 98
2. The crane lifts pipe 112 and seats the pipe on the pitch and roll frame 68 after going through the opening 6 in the heave platform 66
3. Compliant rollers 116 are set on the heave platform 66 engaging the pipe 112 to provide lateral stability
4. One or more tools to be used down-hole are lifted by crane 46 and hung off in pipe 112 and riser extension 64.
5. The crane lifts coil tubing injector 120 and it is set and secured in cradle 119 which is at the top of framework or pipe 112

Equipment Configuration for Downhole Operations

Figure 14:
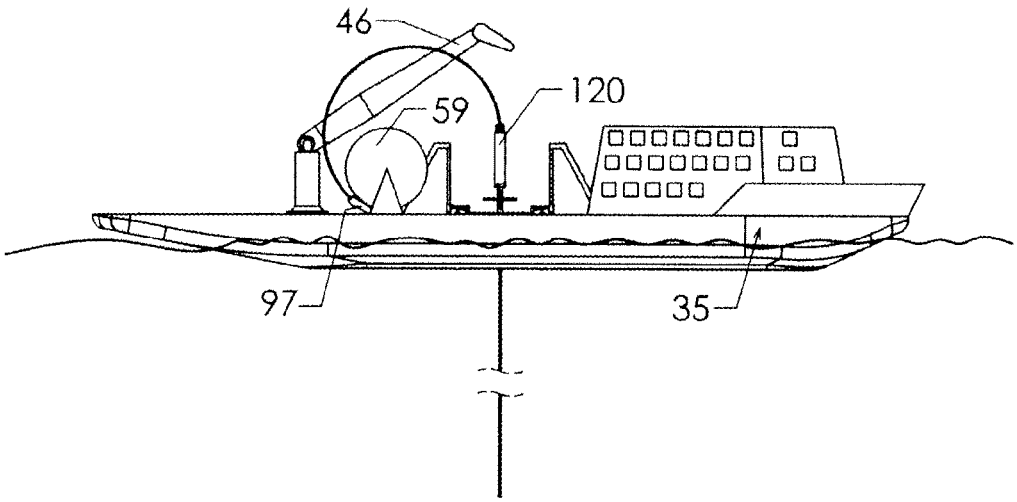
FIG. 14 is a schematic view of the arc of the coil tubing from the reel to the injector on the riser interface system with the heave platform in the lower position.

Referring to FIG. 14, intervention vessel 35, with reel 59 and crane 46, is shown with coil tube injector 120 assembled on the RIV System 60. The desired downhole tooling has been attached to the coil tubing and operations are ready to begin.

Figure 14A:
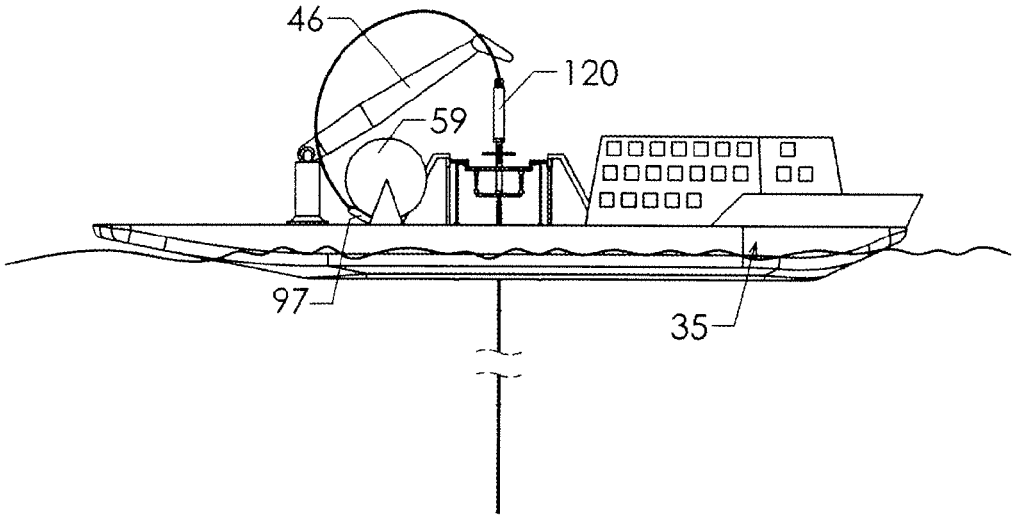
FIG. 14A is a schematic view of the arc of the coil tubing from the reel to the injector on the riser interface system with the heave platform in the upper position.

The above equipment and its specific arrangement provide a novel arc of tubing to be used in the present invention to extend the fatigue life of the tubing (see FIGS. 14 and 14A). This allows the injector and down-hole tubing to be fixed to the earth while the reel moves with the deck of the vessel. A reversible straightener 97 that can have a level wind function is used to change the radius of the tubing to equal or slightly less than the radius of the reel as the tubing is wound onto the reel so that tubing stays neatly snug to the reel without the need to maintain tension on the end of the tubing. For operations, reel 59 deploys tubing back through reversible straightener 97 which changes the radius of curvature to that of the arc. The tubing from straightener 97 creates an arc of tubing that goes up from the reel and back down into injector 120. A second straightener 99 (see FIG. 13) mounted above the injector preferably straightens the tubing from the radius of the arc to nearly straight to suit the riser. Straightening the tubing in this manner reduces friction drag between the tubing and the casing of the riser and well. This action is reversed as the tubing is recovered so that straightener 99 sets the radius of curvature of the tubing to that of the desired arc and straightener 97 at the reel changes the radius of curvature to suit the reel. This novel arrangement requires the curvature of the tubing to be changed only from the diameter of the reel to straight, and back to the diameter of the reel for each deployment, thus extending the fatigue life of the tubing.

The Riser Vessel Interface System tensions the riser extension and supports the CT injection equipment with isolation from vessel motions. Thus the CT reel moves with vessel motions while the injector 120 is fixed to the earth, and the arc of tubing between the injector and the tubing reel provides sufficient length to flex with vessel motions without significantly fatiguing the tubing. The length of tubing in the arc is not in tension and is not loaded other than as due to internal pressure and self weight. These provisions allow extended down-hole operations from a vessel subject to high motions without significant tubing fatigue due to vessel motions. Referring to FIGS. 14 and 14A, it is noted that the arc of the tubing is higher off the deck when the injector 120 is raised by the stabilized system 62, or more specifically, when the vessel and reel heave down with respect to the riser which is fixed to the earth.

A further advantage of this novel arrangement is that all flexure due to vessel heave occurs in the arc and, based on the known distance from the water surface to the down-hole work location at the reservoir elevation, the tubing can be arranged such that the section of tubing that flexes does not include girth welds and other features that are more sensitive to fatigue. This further enhances the fatigue life of the tubing.

This arrangement places the CT reel near the vessel center of motion (which is conveniently near the moonpool). Thus the motion of the reel with respect to the injector is minimized, further improving the fatigue life of the tubing. The weight of the full length of tubing is substantial for deep wells, and the tubing requires heavy equipment for the reel drive and injector. These weights may require strengthening of the vessel. Placing the reel and the injector close together in this manner also minimizes the shift of the center of gravity of the tubing as it moves between the reel and the injector during deployment and recovery of the tubing. This arrangement thus localizes any need for strengthening.

This arrangement facilitates using a large diameter reel for the tubing to further extend tubing fatigue life. The practical limit on the diameter of the reel is thus not offshore operations, but only transportation and handling to get the tubing to and onto the intervention vessel.

It is apparent that the arrangement described could be adapted for location of the injector on a porch that extends out past the deck, with the primary disadvantage being greater distance from the vessel center of motion.

The method and apparatus described herein enables a vessel much smaller than a typical deep water MODU to maintain tension in a riser extension and support the weight of equipment on the riser extension while the riser extension and everything mounted on it remain essentially fixed to the earth and the vessel is free to move in pitch, roll, heave and yaw and has a reasonable range of freedom in surge and sway (position). Thus all six degrees of vessel freedom are accommodated while the vessel maintains structural engagement to the riser extension. This method and apparatus are of particularly high utility when a vessel subject to high motions is interfaced to a Self Supporting Riser (SSR) that is attached to hydrocarbon production equipment founded at the seafloor in the open ocean. The SSR is assumed to be similar to that described elsewhere herein.

Controls

The injector sets the speed and direction of the tubing. The reel drive control system turns the reel to match the motion of tubing through the injector and accommodates tolerances by sensing the position of the tubing arc and incrementing the reel motion as necessary to keep the arc within proscribed limits.

The reversible straightener(s) 97 and 99 straighten tubing as it is deployed, or bend the tubing to the radius of the arc and then the reel as tubing is recovered. During deployment and recovery, optical, mechanical, or electrical sensors detect the range of motion of the arc so the controls can increment the position of the reel as appropriate to adjust for tolerance in the speed control and maintain the nominal length of tubing in the arc. A level wind function can readily be incorporated with the mounting for the straightener at the reel.

Alarm and annunciation functions can be incorporated along with manual override provisions for operator interface. A reference signal separate from injector speed allows control of the reel drive for initiating the arc during setup.

Preparations for CT Vessel Operations

Figure 12:
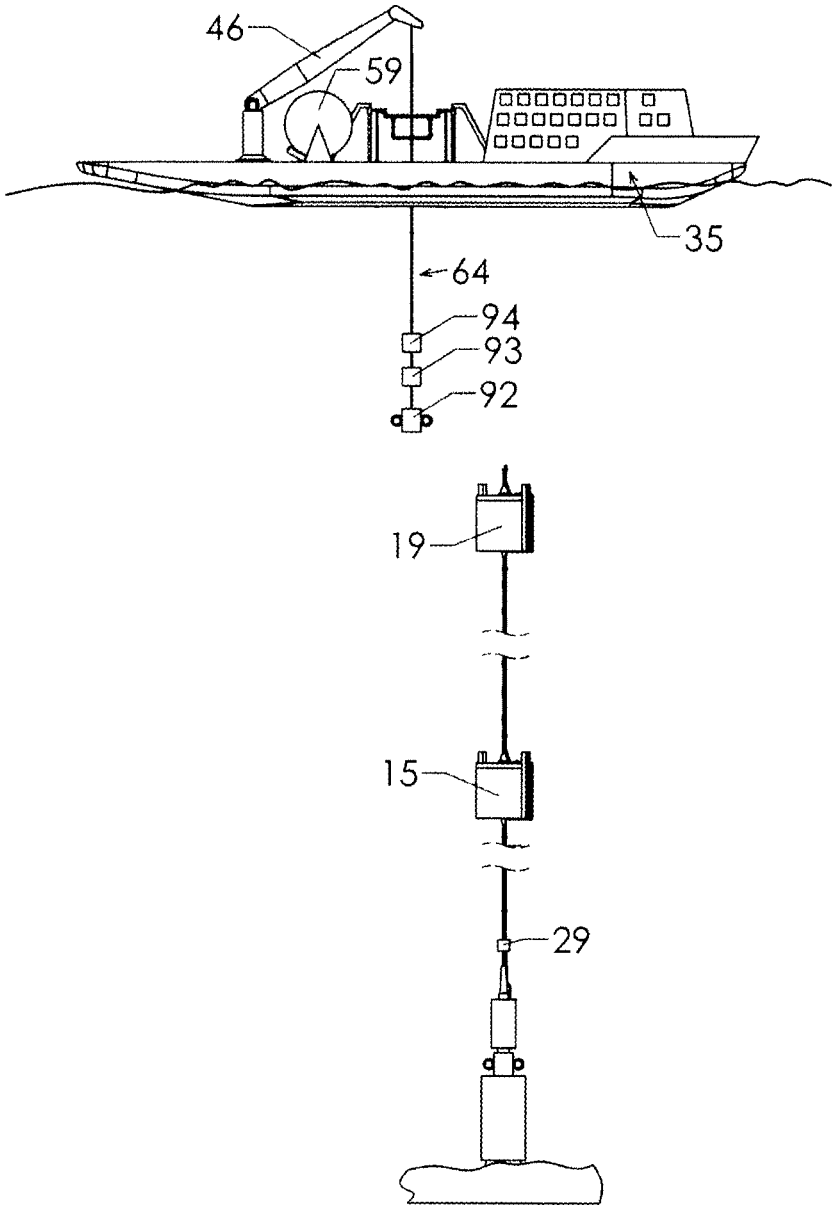
FIG. 12 is a schematic view of an intervention vessel with the riser extension to be connected to an existing SSR.

An overview of the method for intervention vessel operations is as follows:

1. The SSR is found as in FIG. 7 or 7A, either moored or already on the well.
2. As shown in FIG. 12, the riser extension with remotely operated connector is deployed by the intervention vessel and connected to the SSR, and an umbilical jumper is installed from the vessel and connected to the electro-hydraulic control umbilical previously installed with the SSR.
3. The crane hands off the riser extension to the RVI which subsequently maintains tension in the riser extension.
4. If the SSR was found moored, the intervention vessel moves it to the well by engaging the riser extension or a lift line, ballasting buoyancy to make the SSR heavy in water, and supporting the SSR while moving it to the well before restoring the SSR buoyancy.
5. After any necessary testing, a tool string is upended and lifted by heave compensated crane and lowered into the riser extension and hung off at pipe 112.
6. The injector and associated equipment for CT or wire line are lifted and set on the RVI system and the CT tubing or wire line is connected to the tool assembly and deployed through the SSR for downhole operations.
7. When down-hole operations are completed, the SSR can be restored to its as found condition before the SSR is abandoned, as in FIG. 7 or 7A.

Contingency Provisions

Emergency Disconnection of Intervention Vessel

During routine operations, disconnection from SSR 10 is done by recovering the coiled tubing, wire line or pipe; closing seafloor shutoff 11; closing the isolation device 93 at the lower end of the riser extension 64, and disengaging the riser extension and control umbilical from the top of SSR 10. The riser extension remains with vessel 35 as the vessel moves away. In the event of a DP failure or other vessel emergency the vessel can quickly be free to maneuver by closing device 11 and disconnecting from the SSR. The SSR can maintain structural integrity if the vessel pulls the top horizontally by typically 5% to 10% of water depth, so there is ample time to execute the disconnect procedure which requires closing the Seafloor Shutoff Device 11, shearing deployed tubing, line or pipe near the bottom of the riser extension 64, and disconnecting the riser extension from the SSR 10.

Figure 15:
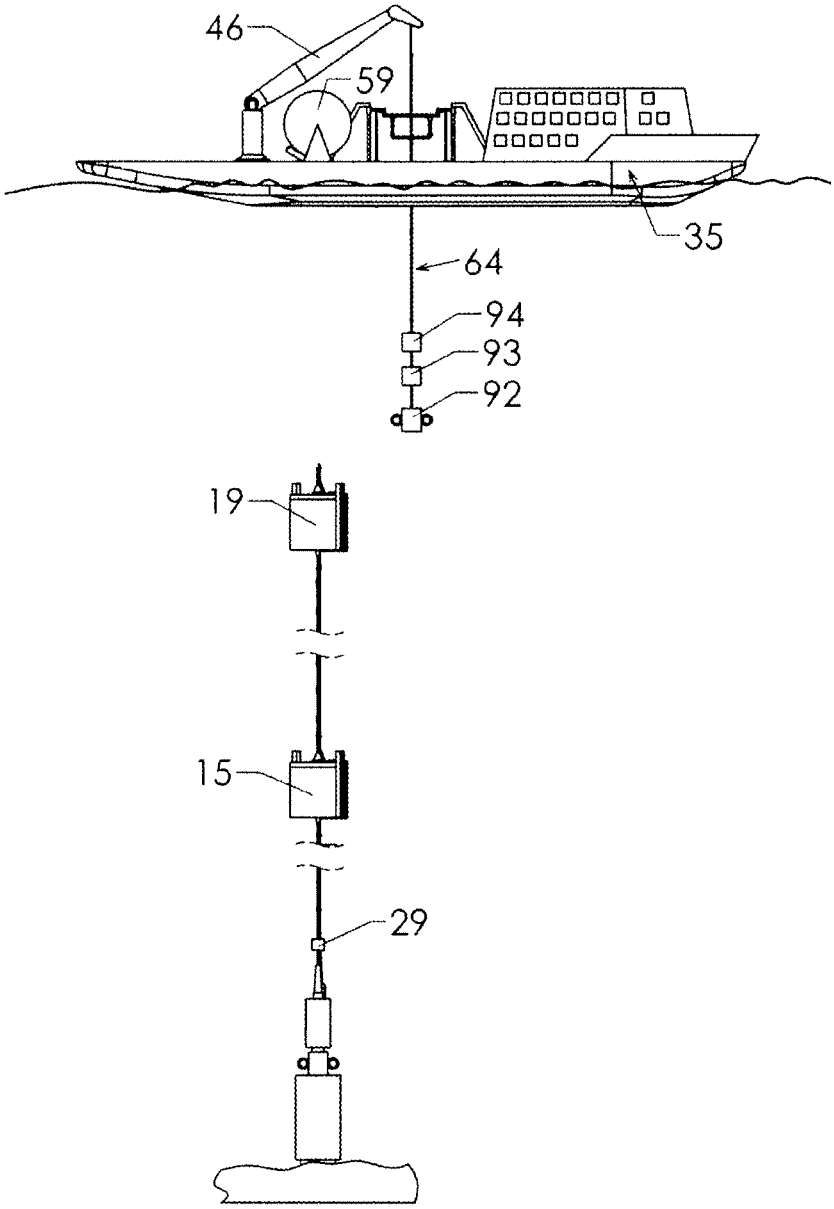
FIG. 15 is a schematic view of an intervention vessel with the riser extension disconnected from the SSR and departing.

The system configuration for both routine and emergency vessel departure is illustrated in FIG. 15.

An outline procedure for emergency disconnection from the SSR is as follows:

1. An emergency disconnect decision is made.
2. Depending on the situation, deployed tubing can be sheared at the seafloor or at the specialty joint 99 in the riser extension 64, or both places.
3. Either the Seafloor Shutoff Device or the mid-water isolation function of specialty joint 18, or both, can be closed to isolate the reservoir.
4. The riser extension and umbilical from the vessel are disconnected from the SSR and the intervention vessel is free to depart.

Under these conditions it may be necessary to disconnect the riser extension from the SSR while the center of gravity of the riser extension assembly is above the RVI system described herein. Without the connection to SSR 10, the passive pitch and roll stabilization system described above is unstable if its load is top heavy and it will allow the riser to incline. Inclination can be avoided by locking the pitch/roll cylinders by closing valves to prevent exchange of fluid between cylinders.

Figure 9G:
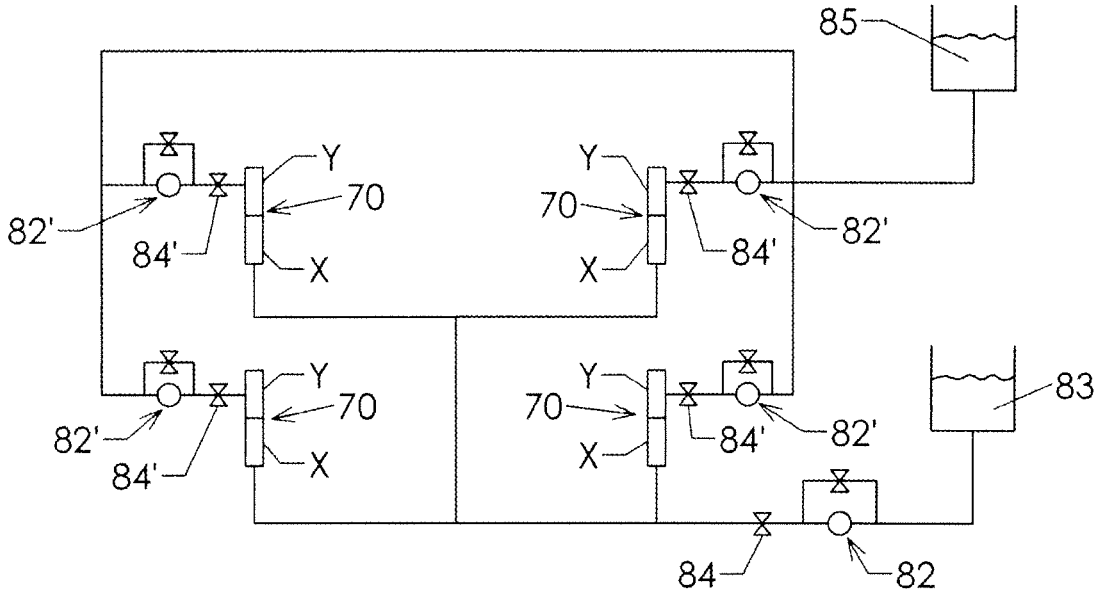
FIG. 9G is a schematic diagram of the hydraulic system for the pitch and roll frame showing further specifics.

Referring to FIG. 9G, each cylinder 70 has a control provision of a valve 84' and pump/bypass valve assembly 82' connecting the non-loaded chamber Y of all cylinders 70. This schematic illustrates provisions for active control of the pitch and roll stabilization system. Valves 84 and/or 84' can be closed to lock frame 68 with respect to platform 66. Active control can be achieved with valve 84 closed and 84' open, and using any three of pump/valve assemblies 82' for active control of the inclination of frame 68 in response to reference and feedback signals. The valves may be on either the load bearing or non-load bearing side or both sides. Alternately, control of the pitch/roll cylinder can be switched to an active mode with reference signals based on sensors.

In the active control mode, inclination is measured and used as feedback for comparison to the nominally vertical orientation of the riser extension. The error signal thus generated is used to control flow of fluid to selected chambers Y of the pitch/roll stabilization cylinders configured as discussed above. Heave stabilization may continue to function, or it can be turned off. Before it is turned off the extension of the heave stabilization cylinders can be adjusted to place the riser engagement at or in close proximity to the vessel center of motion for pitch and roll, thus reducing the loads on the pitch/roll stabilization system.

This active control of pitch/roll cylinders 70 can also be used while disassembling equipment from atop the riser extension after disconnection from the SSR. The passive method stated above is preferred for routine operations because it offers the advantage of functioning without depending on power or proper function of control components and therefore consumes less energy and has fewer failure modes.

Exceptional Vessel Heave

Different contingency conditions exist if an exceptional swell causes the vessel to rise or fall far enough to exceed the available stroke of the heave stabilization cylinders or if the buoyancy module breaks free of the seafloor infrastructure or its anchor and pushes upward on the riser extension between the buoyancy module and the vessel. Each of these contingencies must be dealt with for the safety of the vessel and protection of the equipment and the environment, and each may require a different response. The system is therefore capable of distinguishing the conditions by sensing multiple parameters. The appropriate response depends on a number of variables including the weight of the riser extension and the equipment mounted on the stabilized frame; the degree of extension of the heave stabilization cylinders at the onset of the contingency; the allowable or unavoidable delay between onset of the contingency and the response; sea state conditions; configuration of the specific vessel; etc. The controls, mechanisms, and structures must be suitable to execute an adequate response, as described below. Analysis of possible events for the specific equipment and operations, and pre-programmed responses by the controls system help ensure timely manual or automatic response, or automatic response subject to override by an operator.

Heave Stabilization Cylinders Hit Full Retraction Limit

A contingency situation would exist if an exceptional swell were to lift the vessel past the point at which the heave stabilization cylinders 72 are fully retracted while the riser extension is attached to the SSR and held by stabilization system 60. If this were to happen without the appropriate response it could apply added displacement of the vessel to lifting the riser extension. Riser tension would increase, potentially to destructive levels. Upon sensing this condition, the control system can vent the fluid from the load bearing side of the pitch/roll stabilization cylinders 70 to allow them to travel to their stops to add some range to the allowable vessel excursion. This is accomplished by a pressure relief through valve 84 and the valve of valve/pump assembly 82 on the load bearing side of the pitch/roll stabilization cylinders. Other optional provisions to preclude excessive tension in the riser include releasing a telescoping section in riser extension 64. The telescoping section maintains a fixed length unless it is released by either the control system or a break away attachment which releases due to excessive tension.

Heave Stabilization Cylinders Fully Extended

A different contingency would exist if an exceptional swell caused the vessel to fall past the point at which the heave stabilization cylinders 72 are fully extended while the riser extension is attached to the SSR and held by the stabilization system 60. In this case stabilization system 60 would no longer be able to support the weight of the equipment on the riser extension and maintain tension in the riser extension. Hydraulic pressure would hold the heave stabilization cylinders fully extended, but the force generated hydraulically would all be reacted by the stops and within the structure of stabilization system 60. The weight of the riser extension and the associated equipment above it would load riser extension 64 in compression and push down on the buoyancy module. To a degree the system is self protecting under this condition so long as the riser extension and the stabilization system are designed with sufficient strength because if this downward force exceeds the net upward force of buoyancy module 19 it will push the buoyancy module down. SSR 10 will first give up the stretch that was induced by the normal upward force of the buoy, and will then bow out to absorb additional downward excursion of the buoyancy module. Damage to the system is unlikely if the duration of the downward force is short. However, this situation is preferably avoided because the system is designed to work in tension and the depressed configuration is inherently unstable in that the buoyancy module will move to the side and attempt to roll over if given time.

Multiple provisions are therefore included to limit the maximum compression in the riser extension, and the choice of which sequence to implement depends in part on the nature of the operations in progress at the time of the contingency. One such provision is inclusion of a telescoping section in the riser extension 64. The telescoping section is normally held at a fixed length but it is free to shorten if the riser extension goes into compression. The maximum compression force that can be seen in the riser extension is then the force required to overcome friction and shorten the telescoping section. Any downward force greater than that required to operate the telescope will be supported by the RVI structure, including the load above the riser extension. The telescoping section reacts bending moments so the riser extension remains vertical, even when top heavy.

A further but less desirable provision is to ensure that no part of the weight of the vessel is added to the compression load on riser extension 64 by leaving the heave stabilization cylinders 72 free to be lifted off their foundations by upward force of the buoyancy module on the riser extension. These cylinders can be mounted in sleeves or attached to guides that restore the cylinders to their proper position when the vessel heaves back up. This requires guide rails 73 for the heave platform to be longer than the maximum normal extension of the rods of heave cylinders 72. Transient loading when the cylinders return to their foundations can be reduced by shock absorbing material or devices between the foundations and the cylinders.

A more extreme step is taken, if necessary, by shedding load from above frame 68. If, for instance, frame 68 is supporting down-hole coiled tubing from injector 120, the tubing can be sheared and dropped to reduce load. This is done only under extreme circumstances, and can be delayed long enough to give the vessel a chance to rise back up as the swell passes. The vessel heaving down beyond the active range of heave stabilization cylinders 72 and causing a compression in the riser extension would reverse the load on the pitch and roll stabilization cylinders. Some additional range of vessel heave can be achieved by venting the normally non-load bearing side of the pitch and roll stabilization cylinders to allow them to move to their mechanical limit position. Further, if the load reverses it may be desirable to deliberately move the cylinders to a known condition for other reasons. This can be done actively or by allowing the load to move them to their limits. Valve 84 between the load bearing sides of the pitch/roll cylinders and the hydraulic reservoir normally trap a constant volume of fluid which is free to flow between the load bearing chambers of the pitch and roll cylinders. If the load reverses opening this valve allow flow into the normally load bearing chambers from the reservoir so that the cylinders can move together. If this check valve fails to open the cylinders will begin to move when the pressure in the sealed chambers is reduced to the vapor pressure of the hydraulic fluid. In the passive control mode the non-load bearing chambers of the pitch and roll stabilization cylinders normally exchange fluid with a reservoir to compensate for thermal expansion and any leakage. Opening valve 84 under these conditions therefore allows the pitch/roll cylinders to move to their mechanical limit, thereby providing additional stroke range for the stabilization system 60.

Structural Failure of the SSR

A third type of contingency situation would occur if any segment of SSR 10 were to break free due to structural failure of the SSR while the riser extension is held by stabilization system 60 in which case the buoyancy module would then put the riser extension in compression. The control system therefore includes sensors to distinguish between the potential causes of compression in the riser extension and to prevent release of the telescoping section if compression in the riser extension is due to structural failure of the SSR. This includes sensors 24 in SSR 10 and/or comparison of signals from accelerometer(s) on the vessel structure to a signal proportional to the position or rate and direction of movement of the rods of heave cylinders 72.

If the buoyancy module were to break free, the riser extension would go into compression but the load on pitch/roll cylinders 70 and heave cylinders 72 would not reverse if the weight of equipment on the riser extension were greater than the net upward lift of the buoyancy module. As an example, this situation could occur if a long length of coiled tubing had been deployed into the riser and was being supported by injector 120. The upward force available to compress the riser extension will be no more that the tension in the SSR at the point of failure. If riser structural failure occurs where tension is low, as for instance near the seafloor or closely above a mid-water buoyancy module, the upward force on the riser extension is equally low and may not result in load reversal on the hydraulic cylinders. The cylinders and buoyancy module 19 share the load in this situation and buoyancy would cause the buoy to move sideways and cause an overturning moment on buoyancy module 19 until excess buoyancy is vented.

The proper response to the event depends on sensing to fully identify the situation. This can include sensing pressure and pressure excursions in either or both of the load bearing hydraulic circuits in addition to the sensors discussed above. This situation requires discontinuation of the use of riser extension tension as the primary reference signal for the heave cylinder supply pump(s) and substitution of the alternate reference signals discussed above. Immediately upon confirmation that the SSR has in fact broken free umbilical 12 is used to vent SSR buoyancy to reduce and eliminate its upward force. After venting eliminates the compression force in the riser extension and the SSR the vessel is no longer in immediate danger and the situation can be evaluated and dealt with by the personnel onboard. Venting is stopped as soon as compression in the riser extension reverts to tension, thereby avoiding transfer of weight of SSR 10 to the RVI.

Preferably the pitch/roll stabilization cylinders also have provisions to deal with compression in the riser extension in a preplanned manner because the normal passive mode of the pitch/roll cylinders depends on the lower end of the riser extension being secured to the top of the SSR while the SSR is secured to the seafloor. If this connection to the seafloor is lost, as for instance if the SSR breaks free, passive operation of the pitch and roll stabilization cylinders would allow the riser to freely incline within the range of the pitch and roll stabilization system, resulting in large bending moments. If vessel motions are not large the pitch/roll cylinders can be locked or driven to their mechanical stops to lock the riser extension to the vessel. Bending moments in the riser extension are then reacted through the RVI structure to the vessel hull while and until buoyancy is vented sufficiently to eliminate compression in the riser extension. If vessel motions are too great to allow this approach or if other conditions warrant, the control system includes provisions for active control of the pitch/roll cylinders as described above to hold the riser vertical.

Simply opening a valve at the top of a bottom vented gas filled buoy does not ballast a chamber quickly because the pressure to push the gas out is quite low, being in seawater approximately 0.44 psi per foot of elevation difference between the top and the bottom of the gas in the buoyancy chamber. Umbilical 12 makes it possible to vent substantially faster by incorporating tube(s) of suitable diameter up to a vent above the water surface. The pressure driving the gas to vent is then one atmosphere less than sea water ambient at the elevation of the buoyancy module.

The invention claimed is:

1. An apparatus for the installation and recovery of a self-supporting riser, said apparatus comprising:

a vessel capable of floating in a body of water; further wherein the vessel comprises:

a keel connected to a bottom surface of the vessel;

a deck connected to a top surface of the vessel, a crane connected to a top surface of said deck;

a moon pool disposed below a bottom surface of said deck, said moon pool having a surface area;

a retractable moon pool cover detachably connected to at least one end of said moon pool and capable of covering the surface area of said moon pool, said retractable moon pool cover having a slot capable of supporting a riser suspended below the vessel, and at least one opening capable of mounting at least one tool to said moon pool cover;

tracks connected to said top surface of said deck; and a gantry mounted to said tracks movable over said deck to a position near said moon pool cover.

2. An apparatus according to claim 1, wherein the vessel further comprises at least two guide rails in said moon pool.

3. An apparatus according to claim 2, wherein said guide rails are capable of extending below the keel of said vessel when in operation.

4. An apparatus according to claim 1, wherein said at least one tool is a set of tongs for joints connected by rotation.

5. An apparatus according to claim 1, wherein said at least one tool is capable of tensioning bolts and running nuts for joints connected by flanges.

* * * * *